United States Patent [19]

Deguchi et al.

[11] Patent Number: 4,772,546

[45] Date of Patent: Sep. 20, 1988

[54] SILVER HALIDE PHOTOGRAPHIC MATERIAL WITH HIGH INTERIMAGE EFFECTS

[75] Inventors: Naoyasu Deguchi; Tetsuro Kojima; Hideo Miyazaki; Shigeru Ohno; Koki Nakamura, all of Kanagawa, Japan

[73] Assignee: Fuji Photo Film Co., Ltd., Kanagawa, Japan

[21] Appl. No.: 917,643

[22] Filed: Oct. 10, 1986

[30] Foreign Application Priority Data

Oct. 16, 1985 [JP] Japan ..... 60-230829
Dec. 27, 1985 [JP] Japan ..... 60-293932

[51] Int. Cl.[4] ..... G03C 1/06; G03C 1/46; G03C 1/08; G03C 7/32

[52] U.S. Cl. ..... 430/603; 430/502; 430/503; 430/505; 430/509; 430/544; 430/551; 430/558; 430/611

[58] Field of Search ..... 430/603, 544, 558, 551, 430/611, 502, 503, 505, 509

[56] References Cited

U.S. PATENT DOCUMENTS

Re. 31,893 5/1985 Sugita et al. ..... 430/544
4,467,029 8/1984 Nishide et al. ..... 430/603
4,475,563 10/1984 Ichijima et al. ..... 430/549
4,696,894 9/1987 Deguchi et al. ..... 430/551

*Primary Examiner*—Mukund J. Shah
*Attorney, Agent, or Firm*—Sughrue, Mion, Zinn, Macpeak, and Seas

[57] ABSTRACT

A silver halide photographic material is described, having at least one light-sensitive silver halide emulsion layer containing an iodine-containing silver halide on a support and having one or more auxiliary layers on the outermost surface of a light-sensitive silver halide emulsion layer positioned farthest from the support, wherein at least one of the auxiliary layers contains a substantially non-light-sensitive silver halide emulsion or a silver halide emulsion containing grains whose inner part or surface part is fogged, and the material contains at least one compound represented by formula (I)

(I)

wherein R, X, Y, Z, and n are described in the specification.

19 Claims, No Drawings ylic acid group, hydroxy group, and an alkoxycarbonyl group; Y represents

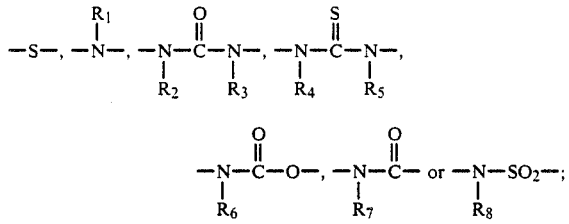

$R_1$, $R_2$, $R_3$, $R_4$, $R_5$, $R_6$, $R_7$, and $R_8$ each represents hydrogen atom or a substituted or unsubstituted alkyl, aryl, alkenyl, or aralkyl group; X represents hydrogen atom, an alkali metal atom, an ammoniumyl group, or a precursor capable of being replaced with hydrogen atom or an alkali metal under an alkali condition; and n is 0 or 1.

DETAILED DESCRIPTION OF THE INVENTION

The compounds of formula (I) are explained in more detail hereunder.

R represents a straight or branched alkylene group preferably having from 1 to 12 carbon atoms, more preferably from 1 to 6 carbon atoms (such as methylene group, ethylene group, propylene group, butylene group, hexylene group, 1-methylethylene group, etc.), a straight or branched alkenylene group preferably having from 2 to 12 carbon atoms, more preferably from 2 to 6 carbon atoms (such as vinylene group, 1-methylvinylene group, etc.), a straight or branched aralkylene group preferably having from 7 to 18 carbon atoms, more preferably from 7 to 12 carbon atoms (such as benzylidene group, etc.), or an arylene group preferably having from 6 to 18 carbon atoms, more preferably from 6 to 12 carbon atoms (such as phenylene group, naphthylene group, etc.).

Examples of the polar substituents represented by the symbol Z include a substituted or unsubstituted amino group (including a salt thereof, such as amino group, hydrochloride of amino group, methylamino group, dimethylamino group, hydrochloride of dimethylamino group, hydrochloride of diethylamino group, dibutylamino group, dipropylamino group, N-dimethylaminoethyl-N-methylamino group, benzylamino group, diallylamino group, anilino group, bis(2-methoxycarbonylethyl)amino group, bis(2-carboxyethyl)amino group, etc.), a quaternary ammoniumyl group (such as trimethylammoniumyl chloride group, dimethylbenzylammoniumyl chloride group, etc.), an alkoxy group preferably having from 1 to 12 carbon atoms (such as methoxy group, ethyoxy group, 2-hydroxyethoxy group, etc.), an aryloxy group preferably having from 6 to 18 carbon atoms (such as phenoxy group, etc.) , an alkylthio group preferably having from 1 to 12 carbon atoms (such as methylthio group, butylthio group, etc.), an arylthio group preferably having from 6 to 18 carbon atoms (such as phenylthio group, etc.), a heterocyclicoxy group preferably having from 1 to 12 carbon atoms (such as 2-pyridyloxy group, 2-imidazolyloxy group, etc.), a heterocyclic-thio group preferably having from 1 to 12 carbon atoms (such as 2-benzthiazolylthio group, 4-pyrazolylthio group, etc.), a sulfonyl group (such as methanesulfonyl group, ethanesulfonyl group, p-toluenesulfonyl group, etc.), a carbamoyl group (such as unsubstituted carbamoyl group, methylcarbamoyl group, etc.), a sulfamoyl group (such as unsubstituted sulfamoyl group, methylsulfamoyl group, etc.), a carbonamido group (such as acetamido group, benzamido group, etc.), a sulfonamido group (such as methanesulfonamido group, benzenesulfonamido group, etc.), an acyloxy group (such as acetyloxy group, benzoyloxy group, etc.), a ureido group (such as unsubstituted ureido group, methylureido group, ethylureido group, etc.), an acyl group (such as acetyl group, benzoyl group, etc.), an aryloxycarbonyl group preferably having from 7 to 19 carbon atoms (such as phenoxycarbonyl group, etc.), a thioureido group (such as unsubstituted thioureido group, methylthioureido group, etc.), a sulfonyloxy group (such as methanesulfonyloxy group, p-toluenesulfonyloxy group, etc.), a heterocyclic group preferably having from 1 to 12 carbon atoms (such as 1-morpholino group, 1-piperidino group, 2-pyridyl group, 4-pyridyl group, 2-thienyl group, 1-pyrazolyl group, 2-imidazolyl group, 2-tetrahydrofuryl group, 2-tetrahydrothienyl group, 1-imidazolyl group, 2-methyl-1-imidazolyl group, 1-pyrrolidinyl group, etc.), and a cyano group. However, Z is not sulfonic acid group, carboxylic acid group, hydroxyl group, or an alkoxycarbonyl group (such as methoxycarbonyl group, ethoxycarbonyl group, etc.).

The amino group for Z may be substituted with an alkyl group preferably having from 1 to 12 carbon atoms, more preferably from 1 to 6 carbon atoms, an alkenyl group preferably having from 2 to 12 carbon atoms, more preferably from 2 to 6 carbon atoms, an aralkyl group preferably having from 6 to 18 carbon atoms, more preferably from 7 to 12 carbon atoms, or an aryl group preferably having from 6 to 18 carbon atoms, more preferably from 6 to 12 carbon atoms. The substituents may be the same or different in the case of di-substituted amino group.

The quaternary ammoniumyl, sulfonyl, carbamoyl, sulfamoyl, carbonamido, sulfonamido, acyloxy, ureido, acyl, thioureido, and sulfonyloxy group for Z may have an alkyl group, an alkenyl group, an aralkyl group, or an aryl group as described as the substituents for the amino group.

When Y represents

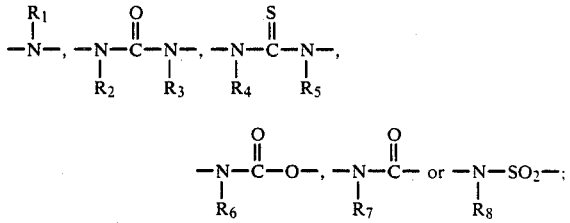

and $R_1$, $R_2$, $R_3$, $R_4$, $R_5$, $R_6$, $R_7$, and $R_8$ each represents hydrogen atom, a substituted or unsubstituted alkyl group preferably having from 1 to 12 carbon atoms, more preferably from 1 to 6 carbon atoms (such as methyl group, ethyl group, propyl group, 2-dimethylaminoethyl group, etc.), a substituted or unsubstituted aryl group preferably having from 6 to 18 carbon atoms, more preferably from 6 to 12 carbon atoms (such as phenyl group, 2-methylphenyl group, etc.), a substituted or unsubstituted alkenyl group preferably having from 2 to 12 carbon atoms, more preferably from 2 to 6 carbon atoms (such as propenyl group, 1-methylvinyl group, etc.), or a substituted or unsubstituted aralkyl

SILVER HALIDE PHOTOGRAPHIC MATERIAL WITH HIGH INTERIMAGE EFFECTS

FIELD OF THE INVENTION

The present invention relates to silver halide photographic materials with high interimage effects and improved sharpness and graininess.

BACKGROUND OF THE INVENTION

When a silver halide color photographic material is developed with a color developer, an oxidized aromatic primary amine-color developing agent in the developer is reacted with a coupler in the material to form indophenol, indaniline, indamine, azomethine, phenoxazine, phenazine or the like dye, and a color image is formed therefrom, which is well known. In this system, a subtractive color process is generally used for the color-reproduction, in which light-sensitive silver halide emulsions which are selectively sensitive to blue, green, and red and the respective complementary yellow, magenta and cyan color image-forming agents are used. For the formation of the yellow color image, for example, an acylacetanilide or dibenzoylmethane-type coupler is used; for the formation of the magenta color image, a pyrazolone, pyrazolobenzimidazole, pyrazolopyrazole, pyrazolotriazole, cyanoacetophenone, or indazolone-type coupler is mainly used; and for the formation of the cyan color image, a phenol or naphthol-type coupler is mainly used.

The dyes formed from these couplers, however, do not show an ideal absorption spectra, and in particular, the magenta and cyan dyes generally show some broad absorption spectra or have some extra-absorptions in a short wavelength range, and these are disadvantageous to the color-reproduction in the color photographic materials.

In particular, the extra-absorptions in the short wavelength range are apt to cause deterioration of the saturation of the dyes. In order to overcome these defects, one means is to intensify the interimage effect, whereby the saturation may be improved in some degree.

The interimage effect is described, for example, in Handon et al., *Journal of the Optical Society of America,* Vol. 42, pp. 663–669; and A. Thiels, *Zeitschrift fur Wissenschaftliche Photographie, Photophysique and Photochemie,* Vol. 47, pp. 106–118 and 246–255.

Regarding means for the intensification of the interimage effect, U.S. Pat. No. 3,536,486 describes the introduction of a diffusive 4-thiazoline-2-thione into an exposed color reversal photographic element, and U.S. Pat. No. 3,536,487 describes the introduction of the diffusive 4-thiazoline-2-thione into a non-exposed color reversal photographic element.

In addition, Japanese Patent Publication No. 34169/73 describes that the existence of an N-substituted-4-thiazoline-2-thione compound in the development of a color photographic material to reduce the silver halide therein to silver is effective for the extreme intensification of the interimage effect.

*Research Disclosure,* RD No. 13116 (March, 1975) describes the provision of a colloidal silver-containing layer between a cyan layer and a magenta layer in a color reversal photographic element to obtain a desirable interimage effect.

U.S. Pat. No. 4,082,553 describes a color reversal photographic material with a layer arrangement such that the transfer of iodide ion is possible during development, in which one layer contains latent image-forming silver iodohalide grains and the other layer contains both latent image-forming silver halide grains and other silver halide grains whose surfaces are so fogged that they may be developed irrespective of the image exposure, whereby a desirable interimage effect may be attained.

However, these methods have serious defects in that the interimage effect is insufficient and that the use of the colloidal silver-containing layer and the introduction of fogged silver halide grains results in deterioration of the color density in the color reversal photographic materials.

Apart from these methods, some other means are known for the improvement of the interimage effect. For example, a coupler capable of releasing a development-inhibitory substance such as a benzotriazole derivative or a mercapto compound in the coupling reaction with an oxidized form of a color developing agent in the color development treatment (or a so-called DIR coupler) is used; or a hydroquinone compound capable of releasing a development-inhibitory substance such as an iodide ion or a mercapto compound in the development is used. However, the use of these compounds is accompanied by extreme desensitization or deterioration of a color density, and therefore, the use of these compounds is to be limited.

SUMMARY OF THE INVENTION

A first object of the present invention is to provide multi-layer color photographic materials which have a high interimage effect and are almost free from variation of the photographic characteristics even under the variation of the composition of a developer used and from the deterioration of any other photographic characteristics.

A second object of the present invention is to provide silver halide photographic materials which are excellent in sharpness and which are almost free from variation of the photographic characteristics even under variation of the composition of a developer used.

A third object of the present invention is to provide black-and-white silver halide photographic materials having high sharpness and good graininess.

These objects of the present invention have been attained by the provision of silver halide photographic materials having at least one light-sensitive silver halide emulsion layer containing an iodine-containing silver halide on a support and having one or more auxiliary layers on the outermost surface of a light-sensitive silver halide emulsion layer as positioned farthest from the support, wherein at least one of the auxiliary layers contains a substantially non-light-sensitive silver halide emulsion or a silver halide emulsion containing grains whose inner part or surface part is fogged, and the material contains at least one compound represented by formula (I)

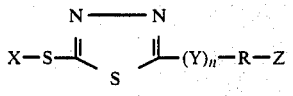

(I)

wherein R represents a straight or branched alkylene, alkenylene, aralkylene, or arylene group; Z represents a polar substituent excluding sulfonic acid group, carbox- The silver halide emulsion containing grains whose surface part is fogged, as used in the auxiliary layer in the present invention, can be an emulsion containing core/shell type silver halide grains which are composed of an inner silver halide nucleus whose surface is fogged and an outer silver halide shell covering the surface. An emulsion containing silver halide grains having surface part less fogged than inner part can also be used.

The silver halide emulsion containing grains whose surface part is fogged may be obtained in various ways, for example, including a method wherein a reducing agent or a gold salt is added to a surface latent image-forming emulsion under appropriate pH and pAg conditions, a method where the emulsion is heated under a low pAg condition or a method where the emulsion is uniformly exposed to light. Usable reducing agents therefor are stannous chloride, hydrazine-type compounds, ethanolamine, and thiourea dioxide.

Silver halide grains whose inner part is fogged may be obtained by deposing a silver halide on the surface of the silver halide grains whose surface part has been fogged, obtained as above, to form an outer shell thereon.

The thickness of the shell to be formed may be regulated by the amount of the silver halide deposited on the surface of the silver halide grains whose surface part has been fogged to form the shell part thereon, depending upon the grain size of the previously surface-fogged silver halide grains.

Preparation of these silver halide grains whose inner part or surface part is fogged is well known and described in patents listed in *Research Disclosure,* RD No. 17643, item I (December 1978).

Examples of the compounds of formula (I) are set forth below, which, however, does not whatsoever restrict the scope of the present invention.

(1)

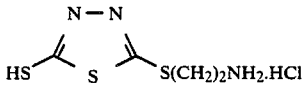

(2)

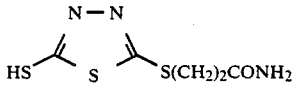

(3)

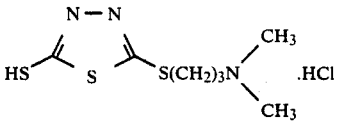

(4)

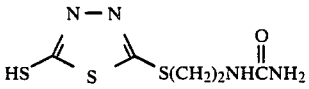

(5)

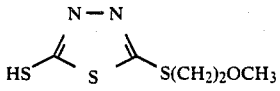

(6)

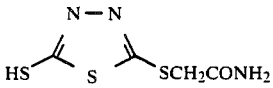

(7)

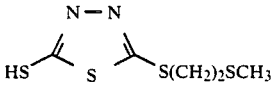

-continued (8)

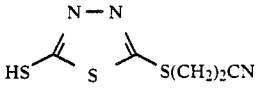

(9)

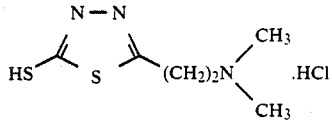

(10)

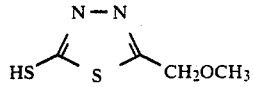

(11)

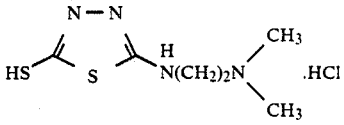

(12)

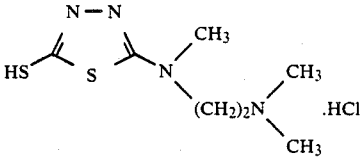

(13)

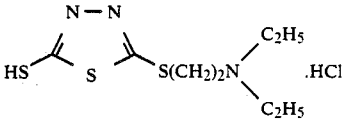

(14)

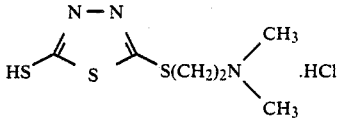

(15)

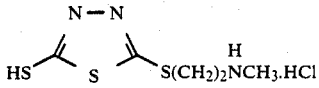

(16)

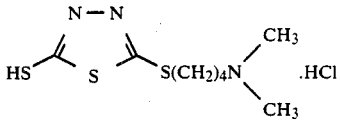

(17)

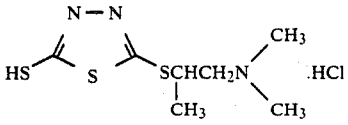

(18)

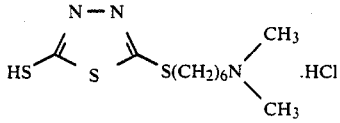

(19)

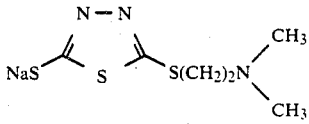

group preferaly having from 7 to 18 carbon atoms, more preferably from 7 to 12 carbon atoms (such as benzyl group, phenethyl group, etc.), with a substituted or unsubstituted alkyl group being preferred.

X represents hydrogen atom, an alkali metal atom (such as sodium atom, potassium atom, etc.), an ammoniumyl group (such as trimethylammoniumyl chloride group, dimethylbenzylammoniumyl chloride group, etc.), or a precursor which is a group capable of being replaced with hydrogen atom or an alkali metal under an alkali condition (pH of 8 to 14, preferably pH of 9 to 12), such as acetyl group, cyanoethyl group, methanesulfonyl group, etc.), with hydrogen atom and sodium atom being particularly preferred.

In formula (I), R is preferably an alkylene group, Y is preferably —S—, and n is preferably 1.

Most preferably, Z is a substituted or unsubstituted amino group or a salt thereof.

The present inventors have found that the compounds of formula (I) of the present invention become highly effective for inhibiting the development of silver halides due to mutual reaction with iodide ion.

When at least one of the compounds of formula (I) is incorporated in the layer to accept an interimage effect, i.e., in which the interimage effect is desired to be actualized (hereinafter referred to as an acceptor layer) or in the adjacent intermediate layer, the development inhibition of the acceptor layer is made extremely high because of the mutual reaction between the compound of formula (I) and the iodide ion as released from the layer to donate the interimage effect (hereinafter referred to as a donator layer) by the development thereof and then diffused into the acceptor layer. It can be said that the interimage effect is larger when the difference of the development inhibition between the part where the donator layer is exposed and developed and the part where the donator layer is not exposed is larger, and the present inventors have found that the compounds of formula (I) can extremely intensify the interimage effect.

However, the compounds of formula (I) have an extremely high reaction rate with iodide ion, and therefore have some defect in that the interimage effect often varies largely because of the variation of the iodide ion concentration in a developer with the result that the photographic characteristics of the material often largely vary.

In order to eliminate the defect, one or more auxiliary layer which do not substantially participate in the image formation is(are) provided on the outermost surface of the light-sensitive silver halide emulsion layer as positioned farthest from the support in the photographic materials of the present invention and at least one of the auxiliary layers contains a substantially non-light-sensitive silver halide emulsion or a silver halide emulsion containing grains whose inner part or surface part is fogged, whereby the iodide ion in the developer is caught by the silver halide emulsion in the auxiliary layer during the development treatment of the material, and thus, the interimage effect does not vary even when there are variations in the iodide ion concentration in the developer, and the material may keep stable photographic characteristics.

Regarding the so-called edge effect, which results from the difference of the developed amount in a layer, simultaneously with the interimage effect which occurs between different silver halide emulsion layers, the materials of the present invention may keep a stable and high edge effect which does not vary even under the variation of the iodide ion concentration in the developer used. More precisely, in the silver halide photographic materials of the present invention containing the compound of formula (I), the iodide ion is released from the part which was more exposed and is diffused into the part which was less exposed, during the development, in the edge between the more exposed part and the less exposed part. By the mutual reaction between the iodide ion and the compound of formula (I), the development of the silver halide emulsion in the material is highly inhibited, and thus, the edge effect may be intensified. It is noted that the intensified edge effect also is apt to vary, depending upon the variation of the iodide ion concentration of the developer used. In the photographic materials of the present invention, however, the auxiliary layer contains a substantially non-light-sensitive silver halide emulsion or a silver halide emulsion containing grains whose inner part or surface part is so fogged that the emulsion may be developed irrespective of the actual exposure, whereby the variation of the edge effect may be neglected even when there are variations in the iodide ion concentration in the developer used.

The degree of trapping of iodide ion in the developer varies, depending upon the amount, grain size and halogen composition of the above silver halide emulsion as well as upon the matter of whether or not the emulsion is non-light-sensitive or fogged, and additionally, upon the thickness of the outer layer of the grains in the case of a fogged emulsion; and thus, the degree may most preferably be regulated in accordance with the composition of the developer to be used and the period of the development time.

The amount of the silver halide emulsion to be contained in the auxiliary layer is preferably from 0.01 to 1 $g/m^2$, and more preferably from 0.03 to 0.5 $g/m^2$.

The grain size of the silver halide emulsion grains as contained in the auxiliary layer is preferably from 0.03 to 0.5 $\mu m$, and more preferably from 0.05 to 0.3 $\mu m$.

The silver halide emulsion used in the auxiliary layer may comprise any of silver chloride, silver bromide, silver bromochloride, silver bromoiodide and silver bromoiodochloride, wherein the iodine content is preferably 3 mole% or less, and especially preferably is 1.5 mole% or less.

The shape of the silver halide grains may be cubic, tetradecahedral, octahedral, spherical or platelike, and the emulsion may be either monodisperse or polydisperse; and in particular, the emulsion is preferably monodipserse (which means that at least 95% of the weight of the total silver halide grains or the number thereof have a grain size falling within the average grain size ±40%).

In the case of black-and-white photographic materials, the emulsion as contained in the auxiliary layer is preferably non-light-sensitive; and in the case of color photographic materials, the emulsion may be either a non-light-sensitive or may contain grains whose inner part or surface part is fogged.

The non-light-sensitive silver halide emulsion is not post-ripened after the formation of the grains therein.

The "silver halide emulsion containing grains whose inner part or surface part is fogged" means a silver halide emulsion capable of being uniformly developed irrespective of the non-exposed part and the exposed part.

-continued (46)

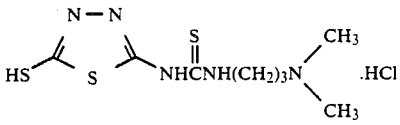

(47)

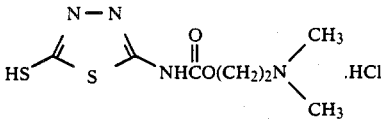

(48)

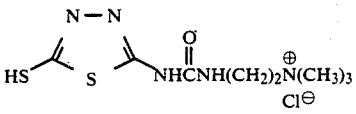

(49)

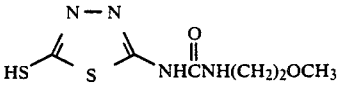

(50)

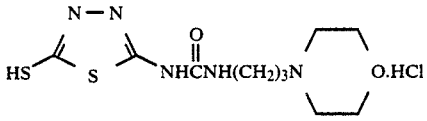

(51)

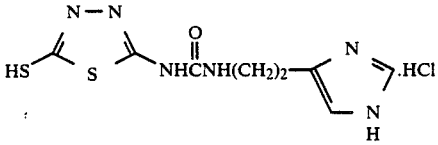

(52)

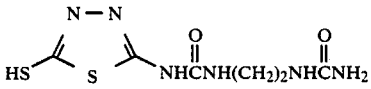

(53)

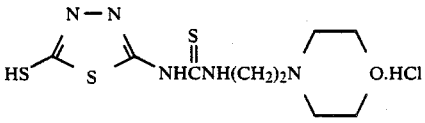

(54)

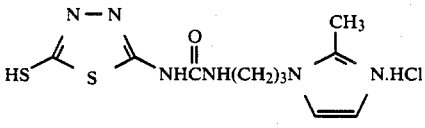

(55)

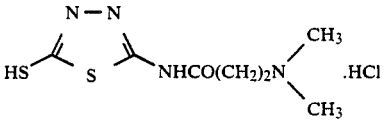

(56)

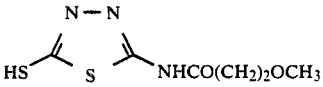

(57)

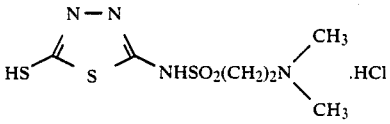

-continued (58)

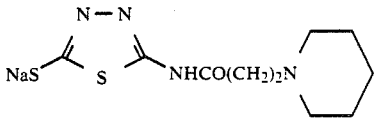

(59)

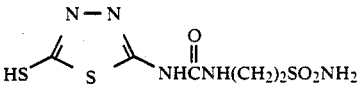

(60)

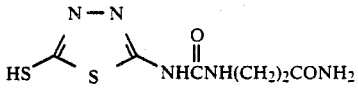

(61)

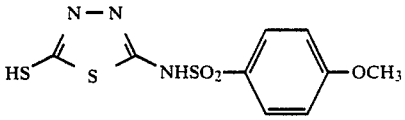

(62)

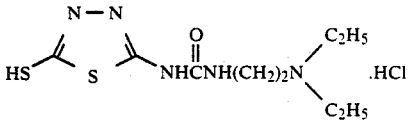

(63)

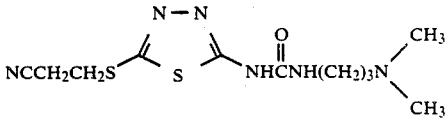

(64)

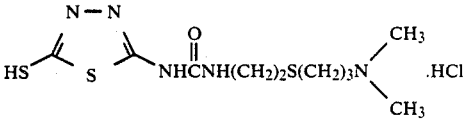

The compounds of formula (I) to be used in the present invention may be obtained by reference to the procedures described in *Advances in Heterocyclic Chemistry,* Vol. 9 (1968), pp. 165–209; *Journal of Pharmaceutical Society, Japan,* Vol. 71 (1951), pp. 1481–1484; and U.S. Pat. No. 2,823,208.

Regarding the compounds of formula (I) where Y represents a ureido group or a thioureido group, these may be easily obtained by reacting a 2-amino-5-mercapto-1,3,4-thiadiazole with an isocyanate or isothiocyanate compound, or by reacting a 2-mercapto-5-phenoxycarbonylamino-1,3,4-thiadiazole with an amine compound.

Some examples for synthesis of typical compounds of formula (I) are shown below.

SYNTHESIS EXAMPLE 1

Synthesis of Compound No. (1)

7.5 g of 2,5-dimercapto-1,3,4-thiadiazole, 5.8 g of 2-aminoethyl-chloride.hydrochloride and 4 g of pyridine were added to 60 ml of n-butanol and heated under reflux for 2 hours. The reaction solution was cooled with ice and the precipitated crystals were removed by filtration and recrystallized in methanol/water (v/v: 5/1). Yield: 7.1 g, m.p.: 228°–229° C. (decomposition).

-continued
(20)
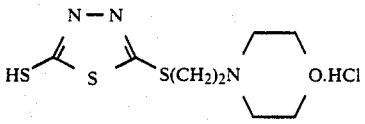
(21)
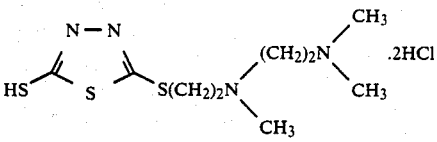
(22)
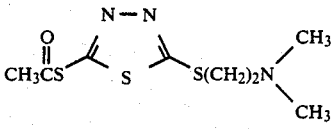
(23)
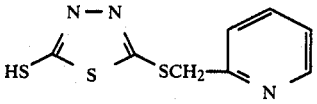
(24)
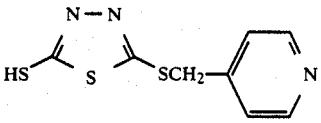
(25)
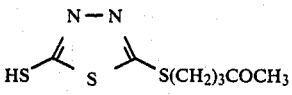
(26)
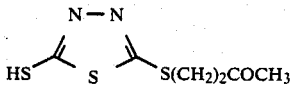
(27)
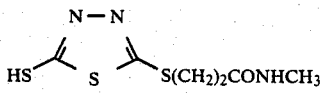
(28)
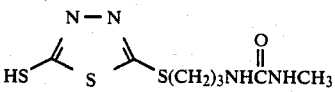
(29)
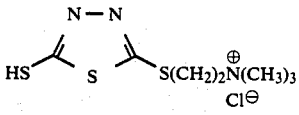
(30)
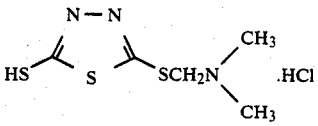
(31)
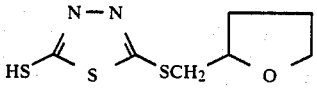
(32)
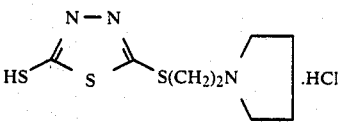
-continued
(33)
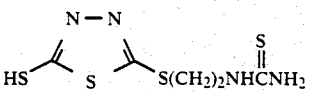
(34)
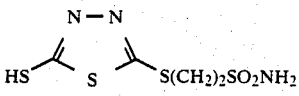
(35)
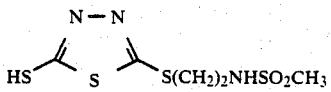
(36)
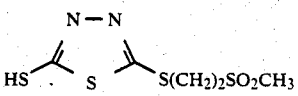
(37)
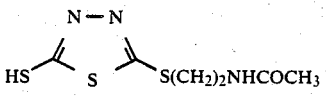
(38)
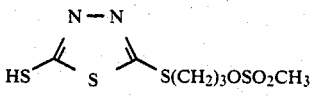
(39)
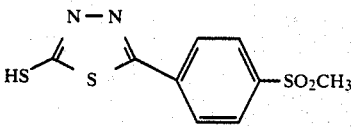
(40)
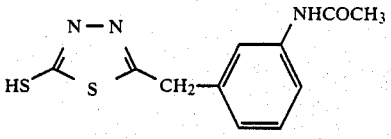
(41)
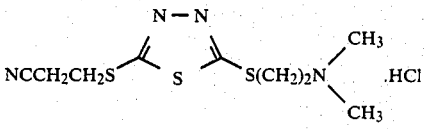
(42)
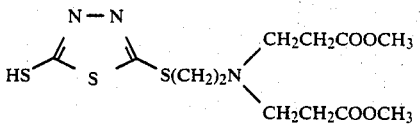
(43)
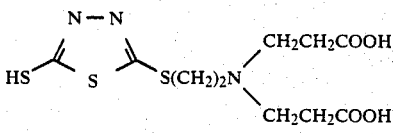
(44)
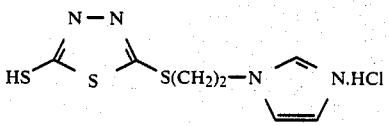
(45)
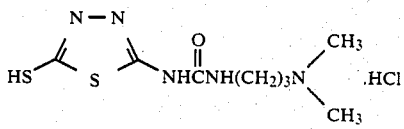

recrystallized in a mixture solvent of methanol/conc. hydrochloric acid (v/v: 9/1) to obtain the Compound No. (46). Yield: 12.6 g, m.p.: 146°-148° C.

SYNTHESIS EXAMPLE 11

Synthesis of Compound No. (50)

100 ml of ethyl alcohol was added to 12.7 g of 2-mercapto-5-phenoxycarbonylamino-1,3,4-thiadiazole, and 8.7 g of 3-morpholinopropylamine was added dropwise thereto at room temperature. After the addition, the combined ingredients were stirred for 5 hours at room temperature, and the precipitated crystals were removed by filtration and recrystallized in a mixture solvent of methanol/conc. hydrochloric acid (v/v: 9/1) to obtain the Compound No. (50). Yield: 10.9 g, m.p.: 255°-257° C.

In the case that the compound of formula (I) is used in a multi-layer color photographic material, this is incorporated in a silver halide emulsion layer(s) or in at least one layer selected from a yellow-filter layer(s), an anti-halation layer(s), an intermediate layer(s), and a protective layer(s) which is adjacent to the emulsion layer; incorporation into a silver halide layers is most preferred.

When the present invention is adapted to black-and-white photographic materials, the compound of formula (I) is incorporated in a silver halide emulsion layer and/or a protective layer.

The amount of the compound of formula (I) to be incorporated in the silver halide photographic material according to the present invention varies, depending upon the property and the use of the photographic material as well as upon the process for the development thereof. Preferably it is from $10^{-1}$ to $10^{-5}$ mole, and more preferably from $3\times10^{-2}$ to $3\times10^{-4}$ mole, per mole of the silver halide contained in the same layer or in an adjacent layer.

For the introduction of the compound of formula (I) of the present invention into the photographic material, the compound is first dissolved in water, methanol, ethanol, propanol, fluorinated alcohol or the like solvent which is generally used as a solvent for photographic materials, and then the resulting solution is added to a hydrophilic colloid. In the case that the compound is to be incorporated into the silver halide emulsion layer(s), it may be added to the emulsion(s) in any time during the formation of the grains, during the physical ripening thereof, just before the chemical sensitization thereof, during the chemical sensitization thereof, or after the chemical sensitization thereof, or in the formation of a coating solution, which may be selected in accordance with the object and the use of the photographic materials.

The present invention may be adapted to any and every photographic material, for example, to color photographic materials including color negative films, color reversal films (coupler-in-emulsion-type or coupler-in-developer-type), color papers, color positive films, color reversal papers, color diffusion-transfer process and dye-transfer process as well as to black-and-white photographic materials including black-and-white negative films, black-and-white photographic papers, X-ray films and lith-films.

A gelatin is advantageously used as the binder or protective colloid to be used in the emulsion layers or intermediate layes of the photographic materials of the present invention, and in addition, hydrophilic colloids other than gelatin may also be used therefor, singly or in the form of a mixture with gelatin.

The gelatin to be used in the present invention may be anyone of a lime-treated gelatin or an acid-treated gelatin. The manufacture of such gelatins is described in detail, e.g., in Arthur Vais, *The Macromolecular Chemistry of Gelatin* (Academic Press, 1964).

In the light-sensitive silver halide emulsion layers (hereafter sometimes referred to as "photographic emulsion layers") of the photographic materials of the present invention, any silver halide may be used such as silver bromide, silver bromoiodide, silver bromochloroiodide, silver bromochloride, and silver chloride, as long as an iodine-containing silver halide such as silver iodohalides is included ion at least one of the photographic emulsion layers. In particular, photographic materials in which at least one photographic emulsion layer contains silver bromoiodochloride, silver bromoiodide, or silver iodochloride having an iodine content of 0.5 to 15 mole% are preferred, as these may bring a favorable result. The iodine content of 1.0 to 12 mole% is more preferred.

The average grain size of the silver halide grains in the photographic emulsion is not specifically limited, and is preferably 3 μm or less. (The grain size is represented by the grain diameter in the case of spherical sphere-like grains or by the length of the side in the case of cubic grains; and the average grain size is represented on the basis of the projected area.)

The grain size distribution may be narrow or broad.

The silver halide grains in the photographic emulsions may have a regular crystalline shape (such as cubic or octahedral crystals) or an irregular crystalline shape (such as sphere-like shape or plate-like shape), or may be in a composite form of these regular or irregular crystals. In addition, the emulsion may comprise a mixture of various grains of different crystalline shapes.

An photographic emulsion in which 50% or more of the total projected area of all of the silver halide grains comprise ultra-plate-like silver halide grains whose diameter is larger than the thickness thereof by 5 times or more may also be used.

The silver halide grains may have different phases in the inner part and the surface part thereof. The grains may be either those capable of forming a latent image mainly on the surface thereof or those capable of forming the same mainly in the inner part thereof.

The photographic emulsions to be used in the photographic materials of the present invention may be prepared in accordance with various known methods, e.g., as described in P. Glafkides, *Chimie et Physique Photographique* (Paul Montel, 1967); G. F. Duffin, *Photographic Emulsion Chemistry* (Focal Press, 1966); and V. L. Zelikman et al., *Making and Coating Photographic Emulsion* (Focal Press, 1964). For instance, any of an acid method, a neutral method, an ammonia method, etc., may be used, and, in addition, a one-side mixture method, a simultaneous mixture method, or a combination thereof may be used for the reaction of a soluble silver salt and a soluble halide.

A so-called reverse mixture method in which silver halide grains are formed in the presence of excess silver ion may also be used. In addition, a so-called controlled-double-jet method, which is one type of a simultaneous mixture method, may also be used, where the pAg value in the liquid wherein the silver halide grains are formed is kept constant.

SYNTHESIS EXAMPLE 2

Synthesis of Compound No. (14)

7.5 g of 2,5-dimercapto-1,3,4-thiadiazole, 7.3 g of 2-dimethylaminoethyl-chloride.hydrochloride and 4 g of pyridine were added to 60 ml of n-butanol and heated under reflux for 2 hours. The reaction solution was cooled with ice and the precipitated crystals were removed by filtration and recrystallized in ethanol. Yield: 7.9 g, m.p.: 161°-163° C.

SYNTHESIS EXAMPLE 3

Synthesis of Compound No. (13)

7.5 g of 2,5-dimercapto-1,3,4-thiadiazole, 8.6 g of 2-diethylaminoethyl-chloride.hydochloride and 4 g of pyridine were added to 60 ml of n-butanol and heated under reflux for 2 hours. The reaction solution was cooled with ice and the precipitated crystals were removed by filtration and recrystallized in ethanol/water (v/v: 4/1). Yield: 10.1 g, m.p.: 184°-186° C.

SYNTHESIS EXAMPLE 4

Synthesis of Compound No. (3)

7.5 g of 2,5-dimercapto-1,3,4-thiadiazole, 7.9 g of 3-dimethylaminopropyl-chloride.hydrochloride and 4 g of pyridine were aded to 60 ml of n-butanol and heated under reflux for 2 hours. The reaction solution was cooled with ice and the precipitated crystals were removed by filtration and recrystallized in ethanol. Yield: 11 g, m.p.: 149°-152° C.

SYNTHESIS EXAMPLE 5

Synthesis of Compounds No. (42) and No. (43)

(1) Synthesis of 2-[N,N-bis(2-methoxycarbonylethyl)amino]ethyl-chloride.hydrochloride 6.1 g of 2-aminoethanol was added to 75 ml of methanol, and 20 ml of methyl acrylate was added dropwise thereto while cooling with ice. After the addition, the combined ingredients were stirred for 2 hours while cooling with ice, and then further stirred for 20 hours at room temperature. The reaction solution was distilled out under reduced pressure to obtain an oil (23 g). 100 ml of chloroform was added to the oil and then 8.7 ml of thionyl chloride was dropwise added thereto while cooling with ice, and thereafter the combined ingredients were heated under reflux for 1 hour. The reaction solution was distilled out under reduced pressure, and the resulting residue was crystallized in isopropanol/n-hexane (v/v: 2/3). Yield: 21 g, m.p.: 103°-104° C.

(2) Synthesis of Compound No. (42)

7.5 g of 2,5-dimercaptothiadiazole, 14.4 g of 2-[N,N-bis(2-methoxycarbonylethyl)amino]ethyl-chloride and 8.1 g of pyridine were added to 80 ml of dioxane and heated under reflux for 2 hours. The reaction solution was distilled out, and the resulting residue was purified by column chromatography (fixed layer: alumina, developer solvent: methanol/ethyl acetate (v/v: 1/9)) to obtain a syrup of the Compound No. (42). Yield: 8.4 g.

(3) Synthesis of Compound No. (43)

7.3 g of the Compound No. (42) was added to 20 ml of 20% sodium hydroxide aqueous solution and stirred for 2 hours at 50° C. The reaction solution was neutralized with 35% hydrochloric acid while cooling with ice, and the formed precipitate was removed by filtration. This was recrystallized in dimethylformamido/ethanol (v/v: 1/9) to obtain the Compound No. (43). Yield: 3.2 g, m.p.: 188°-189° C.

SYNTHESIS EXAMPLE 6

Synthesis of Compound No. (4)

15.0 g of 2,5-dimercapto-1,3,4-thiadiazole and 20 ml of 28% sodium methoxide solution were added to 100 ml of ethylalcohol and heated and dissolved, and then 13.5 g of 2-chloroethylurea was dropwise added thereto. After the addition, the combined ingredients were heated under reflux for 5 hours. After the reaction, the reaction solution was poured into 700 ml of ice-water, and the precipitated crystals were removed by filtration and then recrystallized in methanol. Yield: 16.4 g, m.p.: 174°-176° C.

SYNTHESIS EXAMPLE 7

Synthesis of Compound No. (2)

15 g of 2,5-dimercapto-1,3,4-thiadiazole was added to 300 ml of acetone, and then 22 ml of 28% sodium methoxide solution and 12 g of β-chloropropionamide were added thereto. Next, 15 g of sodium iodide was added to the reaction solution and the combined ingredients were heated under reflux for 20 hours. After cooling, the crystals obtained were removed by filtration and then washed with water. The crystals were recrystallized in a mixed solvent of dimethylformamide/methanol (v/v: 3/7) to obtain the Compound No. (2). Yield: 12.0 g, m.p.: 175°-177° C.

SYNTHESIS EXAMPLE 8

Synthesis of Compound No. (44)

15.0 g of 2,5-dimercapto-1,3,4-thiadiazole, 20.0 g of 1-(2-chloroethyl)imidazole.hydrochloride and 9.5 g of pyridine were added to 100 ml of acetonitrile and heated under reflux for 4 hours. After the reaction, the reaction solution was cooled, and the precipitated crystals were removed by filtration and recrystallized in a mixtured solvent of dimethylformamide/methanol (v.v: 1/4) to obtain the Compound No. (44). Yield: 11.2 g, m.p.: 226°-228° C.

SYNTHESIS EXAMPLE 9

Synthesis of Compound No. (45)

200 ml of acetonitrile was added to 12.7 g of 2-mercapto-5-phenoxycarbonylamino-1,3,4-thiadiazole, and 6.2 g of 3-N,N-dimethylaminopropylamine was added dropwise thereto at room temperature. After the addition, the combined ingredients were stirred under heat at 50° C. for 1.5 hours, and the precipitated crystals were removed by filtration and recrystallized in a mixture solvent of methanol/conc. hydrochloric acid (v/v: 9.1) to obtain the Compound No. (45). Yield: 10.7 g, m.p.: 228°-230° C.

SYNTHESIS EXAMPLE 10

Synthesis of Compound No. (46)

13.3 g of 2-amino-5-mercapto-1,3,4-thiadiazole was dissolved in 100 ml of acetonitrile and 40 ml of dimethylacetamide, and 15.9 g of 3-(N,N-dimethylamino)propyl isothiocyanate was added dropwise thereto at room temperature. After the addition, the combined ingredients were stirred under heat at 50° C. for 2 hours, and the precipitated crystals were removed by filtration and layer, at least one green-sensitive emulsion layer, and at least one blue-sensitive emulsion layer on a support. The order of the provision of these layers on the support may be freely selected in accordance with the object and the use of the materials. In general, the red-sensitive emulsion layer contains a cyan-forming coupler, the green-sensitive emulsion layer contains a magenta-forming coupler and the blue-sensitive emulsion layer contains a yellow-forming coupler, although combinations other than these may also be utilized, if desired.

The same or different photographic emulsion layers or non-light-sensitive layers in the photographic materials of the present invention may contain some other dye-forming couplers, or compounds capable of coloring by oxidation-coupling with an aromatic primary amine developing agent (such as phenylenediamine derivatives or aminophenol derivatives) in the color development treatment. For example, usable couplers are magenta couplers such as a 5-pyrazolone coupler, pyrazolobenzimidazole coupler, pyrazolotriazole coupler, pyrazoloimidazole pyrazolopyrazole coupler, pyrazoloterazole coupler, cyanoactylcoumarone coupler, and ring-opened acyl-acetonitrile coupler; yellow couplers such as an acylacetamide coupler (e.g., benzoylacetanilides, pyvaloylacetanilides); and cyan couplers such as a naphthol coupler and phenol coupler. These couplers are preferably non-diffusive couplers containing a hydrophobic group (which is called a ballast group) in the molecule, or polymerized couplers. The couplers may be either tetra-equivalent or di-equivalent to silver ion. In addition, the couplers may be colored couplers having a color-compensative activity or may be couplers capable of releasing a development-inhibitor during development (so-called DIR-couplers).

The photographic materials of the present invention may also contain non-coloring DIR-coupling compounds which may release a development-inhibitor, but form a colorless product by the coupling reaction, in addition to the DIR-couplers; or may further contain such compounds that are able to release a development-inhibitor during the development, but the DIR-couplers.

Regarding the incorporation of these couplers into the photographic materials of the present invention, two or more kinds of them may be added to the same layer of the material so as to satisfy the necessary characteristics of the material, or otherwise, the same coupler may be added to two or more different layers without any inconvenience.

For the introduction of a coupler into the photographic emulsion layer or non-light-sensitive layer of the photographic material of the present invention, a conventional means, for example a method as described in U.S. Pat. No. 2,322,027, may be utilized. For instance, a coupler is first dissolved in in an organic solvent having a high boiling point, such as an alkyl phthalate (e.g., dibutyl phthalate, dioctyl phthalate), a phosphate (e.g., diphenyl phosphate, triphenyl phosphate, tricresyl phosphate, dioctylbutyl phosphate), a citrate (e.g., tributyl acetylcitrate), a benzoate (e.g., octyl benzoate), an alkylamide (e.g., diethyllaurylamide), a fatty acid ester (e.g., dibutoxyethyl succinate, diethyl azelate), or trimesate (e.g., tributyl trimesate), or in an organic solvent having a boiling point of about 30° C. to about 150° C., such as a lower alkyl acetate (e.g., ethyl acetate, butyl acetate), ethyl propionate, secondary butyl alcohol, methylisobutylketone, $\beta$-ethoxyethyl acetate or methylcellosolve acetate; and then the resulting solution is dispersed in a hydrophilic colloid. These high boiling point-organic solvents and low boiling point-organic solvents may be used in the form of a mixture thereof.

In addition, a dispersion method using a polymer, as described in Japanese Patent Publication No. 39853/76 and Japanese Patent Application (OPI) No. 59943/76 (the term "OPI" herein used means an "unexamined published application"), may also be used.

In case the coupler has an acid group such as a carboxylic acid or sulfonic acid group, this may be introduced into a hydrophilic colloid in the form of an alkaline aqueous solution.

The photographic materials of the present invention may contain an inorganic or organic hardener in the photographic emulsion layers or in some other hydrophilic colloid layers. For instance, usable hardeners are chromium salts (e.g., chromium alum, chrominum acetate), aldehydes (e.g., formaldehyde, glyoxal, glutaraldehyde), N-methylol compounds (e.g., dimethylol-urea, methyloldimethylhydrantoin), dioxane derivatives (e.g., 2,3-dihydroxydioxane), active vinyl compounds (e.g., 1,3,5-triacrylol-hexahydro-s-triazine, 1,3-vinylsulfonyl-2-propanol), active halogen compounds (e.g., 2,4-dichloro-6-hydroxy-s-triazine), mucohalogenic acids (e.g., mucochloric acid, mucophenoxychloric acid), and these may be used single or in the form of a combination thereof.

In the case that the hydrophilic colloid layers of the present photographic materials contain a dye or an ultraviolet-absorbent, these may be mordanted with a cationic polymer or the like.

The present photographic materials may contain a color-fog inhibitor selected from hydroquinone derivatives, aminophenol derivatives, gallic acid derivatives, and ascorbic acid derivatives.

The present photographic materials may contain a ultraviolet absorbent in the hydrophilic colloid layer. For instance, usable ultraviolet absorbents are aryl-substituted benzotriazole compounds (e.g, those as described in U.S. Pat. No. 3,533,794), 4-thiazolidone compounds (e.g., those as described in U.S. Pat. Nos. 3,314,794 and 3,352,681), benzophenone compounds (e.g., those as described in Japanese Patent Application (OPI) No. 2784/71), cinnamate compounds (e.g., those as described in U.S. Pat. Nos. 3,705,805 and 3,707,375), butadiene compounds (e.g., those as described in U.S. Pat. No. 4,045,229) and benzoxazole compounds (e.g., those as described in U.S. Pat. No. 3,700,455). In addition, ultraviolet absorptive couplers (such as $\alpha$-naphthol-type cyan-dye forming couplers) and ultraviolet-absorptive polymers may also be used. These ultraviolet absorbents may be mordanted in a specific layer.

The present photographic materials may contain in the hydrophilic colloid layers a water-soluble dye as a filter dye or for the purpose of irradiation-prevention or for any other various purposes. Dyes usable therefor are oxonol dyes, hemioxonol dyes, styryl dyes, merocyanine dyes, cyanine dyes, and azo dyes. In particular, oxonol dyes, hemioxonol dyes, and merocyanine dyes are preferred.

In the actual practice of the present invention, various known discoloration-inhibitors as mentioned below may be incorporated in the photographic materials, and the image-stabilizers to be incorporated in the present materials may be used singly or in the form of a mixture of two or more thereof. Useful known discoloration-inhibitors include hydroquinone derivatives, gallic acid According to this method, an emulsion containing silver halide grains having a nearly regular crystalline shape and a nearly uniform grain size may be obtained.

Two or more kinds of silver halide emulsions which have been separately prepared by may blended and used in the present invention.

In the formation of silver halide grains or the physicl ripening thereof, a cadmium salt, a zinc salt, a lead salt, a thallium salt, an iridium salt, or a complex thereof, a rhodium salt or a complex thereof or an iron salt or complex thereof may be present.

The silver halide emulsions used in the present invention are generally chemically-sensitized. For the chemical sensitization, a known method may be used, for example, as described in H. Frieser, ed., *Die Grundlagender Photographischen Prozesse mit Silver-halogeniden* (Academische Verlagsgesellschaft, 1968), pp. 675–734.

For instance, various known methods may be used for the chemical sensitization, including a sulfur-sensitization method in which a sulfur-consisting compound capable of reacting with an active gelatin and silver (such as a thiosulfate, a thiourea, a mercapto compound, a rhodanine compound) is used; a reduction-sensitization method in which a reducing substance (such as stannous salt, an amine compound, a hydrazine derivative, a formamidine-sulfinic acid, and a silane compound) is used; and a noble metal-sensitization in which a noble metal compound (such as a gold complex or a Pt-, Ir-, Pd-, or other VIII group metal complex) is used. The sensitization method may be used singly or in the form of a combination of these methods.

Various kinds of compounds may be incorporated in the photographic emulsions to be used in the present invention, for the purpose of prevention of fog or of stabilization of the photographic characteristics of the photographic materials during the formation, preservation, or photographic treatment of the materials. For instance, various kinds of known fog-inhibitors or stabilizers may be used therefor, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, aminotriazoles, benzotriazoles, nitrobenzotriazoles, mercaptotetrazoles (especially 1-phenyl-5-mercaptotetrazoles), etc.; mercaptopyridines; mercaptotriazines; thioketo compounds such as oxazolinethione; azaidines such as triazaindenes, tetrazaindenes (especially 4-hydroxy-substituted-(1,3,3a,7)-tetrazaindenes), pentazaindenes, etc.; benzenethiosulfonic acids, benzenesulfinic acids, benzenesulfonic acid amides, etc.

The photographic materials of the present invention may contain in the photographic emulsion layers or in the other hydrophilic colloid layers, various kinds of surfactants, for the purpose of coating assistance, static charge-prevention, improvement of slide property, emulsification and dispersion, improvement of antiblocking property, and improvement of photographic characteristics (such as acceleration of developability, intensification of high contrast and sensitization).

For instance, the photographic emulsion layers of the photographic materials of the present invention may contain, for the purpose of elevation of sensitivity, intensification of contrast and acceleration of developability, polyalkyleneoxides or derivatives thereof such as ether, ester of amine derivatives, thioether compounds, thiomorpholine compounds, quaternary ammonium salt compounds, urethane derivatives, urea derivatives, imidazole derivatives, or 3-pyrazolidones.

In addition, the photographic materials of the present invention may contain, in the photographic emulsion layers or in the other hydrophilic colloid layers, a dispersion of a water-insoluble or poorly soluble synthetic polymer, for the purpose of improvement of the dimension stability. For example, polymers made of monomer components of alkyl (meth)acrylates, alkoxyalkyl (meth)acrylates, glycidyl (meth)acrylates, (meth)acrylamides, vinyl-esters (such as vinyl acetate), acrylonitriles, olefins or styrenes, or mixture thereof, or made of a combination of a monomer selected from those monomers and other monomers selected from acrylic acids, methacrylic acids, $\alpha,\beta$-unsaturated dicarboxylic acids, hydroxyalkyl (meth)acrylates, sulfoalkyl (meth)acrylates, and styrenesulfonic acids may be used therefor.

The photographic emulsions to be used in the photographic materials of the present invention may be spectrally-sensitized with methine dyes or other sensitizing dyes. Dyes usable therefor are cyanine dyes, merocyanine dyes, complex merocyanine dyes, complex cyanine dyes, holopolar-cyanine dyes, hemicyanine dyes, styryl dyes, and hemioxonol dyes. Especially preferred dyes among them are those belonging to cyanine dyes, merocyanine dyes, and complex mercocyanine dyes. Any and every basic heterocyclic nucleus which may generally be contained in cyanine dyes may be applied to these dyes. For instance, such nuclei include pyrroline, oxazoline, thiazoline, pyrrole, oxazole, thiazole, selenazole, imidazole, tetrazole, pyridine nuclei, etc.; alicyclic hydrocarbon ring-fused heterocyclic nuclei made by fusion of alicyclic hydrocarbon ring with said heterocyclic nucleus; and aromatic hydrocarbon ring-fused heterocyclic nuclei made by fusion of aromatic hydrocarbon ring with said heterocyclic nucleus, such as indolenine, benzindolenine, indole, benzoxazole, naphthoxazole, benzothiazole, naphthothiazole, benzoselenazole, benzimidazole, and quinoline nuclei. These nuclei may be substituted on their carbon atoms.

Merocyanine dyes and complex merocyanine dyes may contain a ketomethylene structure-containing, 5- or 6-membered heterocyclic nucleus such as pyrazolin-5-one, thiohydrantoin, 2-thio-oxazolidine-2,4-dione, thiazolidine-2,4-dione, rhodanine or thio-barbituric acid nucleus.

These sensitizing dyes may be used singly or in the form of a combination thereof, and the combination of these sensitizing dyes is often utilized for the purpose of super-sensitization.

Other dyes which per se do not have any spectral-sensitization activity or some other substances which do not substantially absorb any visible rays, but do have a supersensitization activity may be incorporated in the emulsion, together with the sensitizing dye. For instance, nitrogen-containing heterocyclic ring-substituted aminostyryl compounds (for example, those as described in U.S. Pat. Nos. 2,933,390 and 3,635,721), aromatic organic acid/formaldehyde condensation products (for example, those as described in U.S. Pat. No. 3,743,510), cadminum salts, azaindene compounds, etc. may be incorporated in the emulsion.

The present invention may be adapted to multi-layer and multi-color photographic materials having at least two layers each having a different spectral sensitivity on a support. Multi-layer natural color photographic materials have, in general, at least one red-sensitive emulsion dium carbonate, potassium carbonate, sodium tertiary phosphate, potassium tertiary phosphate, and borax. These compounds may be added to the developer, singly or in the form of a mixture thereof.

The color developer may further contain a preservative such as sulfites (e.g., sodium sulfite, potassium sulfite, potassium bisulfite, sodium bisulfite) and hydroxylamines.

The color developer may also contain any desired development accelerator. Examples of useful development accelerators include various kinds of pyridinium compounds and other cationic compounds, as well as cationic dyes such as phenosafranine, and neutral salts such as thallium nitrate or potassium nitrate, as described, e.g., in U.S. Pat. No. 2,648,604, Japanese Patent Publication No. 9503/69, and U.S. Pat. No. 3,671,247; polyethyleneglycols and derivatives thereof as well as non-ionic compounds such as polythioethers, as described, e.g., in Japanese Patent Publication No. 9504/69, U.S. Pat. Nos. 2,533,990, 2,531,832, 2,950,970, and 2,577,127; organic solvents as well as organic amines, ethanolamines, ethylenediamines, and diethanolamines, as described, e.g., in Japanese Patent Publication No. 9509/69 and Belgian Pat. No. 682,862; and other accelerators as described, e.g., in L. F. A. Mason, *Photographic Processing Chemistry* (Focal Press, 1966), pp. 40–43.

The color developer may further contain a water-softener of an amino-polycarboxylic acid, typical examples of which are ethylenediaminetetraacetic acid, nitrilotriacetic acid, cyclohexanediamine-tetraacetic acid, imino-diacetic acid, N-hydroxymethyl-ethylenediamine-triacetic acid, and diethylenetriamine-pentaacetic acid.

A competing coupler or a compensative developing agent may be added to the color developer.

Useful competing couplers include citrazinic acid, J-acid, and H-acid.

Useful compensative developing agents include p-aminophenol, N-benzyl-p-aminophenol, and 1-phenyl-3-pyrazolidone.

The pH value of the color developer is preferably within the range of about from 8 to 13 or so. The temperature of the color developer is selected from the range of from 20° C. to 70° C., and preferably falls within the range of from 30° C. to 60° C.

After color-development, the photographic emulsion layer is generally bleached. The bleaching treatment may be carried out simultaneously with a fixing treatment, or separately therefrom. Useful bleaching agents include iron(III)-, cobalt(IV)-, chrominum (VI)-, copper(II)-, or the like polyvalent metal compounds, peracids, quinones, and nitroso compounds. Examples of these bleaching agents are ferricyanides, bichromates, and organic complexes of iron(III) or cobalt(III), for example, with an aminopolycarboxylic acid (such as ethylenediamine-tetraacetic acid, nitrilotriacetic acid or 1,3-diamino-2-propanol-tetraacetic acid) or with an organic acid (such as citric acid, tartaric acid, or malic acid); persulfates, permanganates; and nitrosophenols. Among them, potassium ferricyanide, sodium ethylenediamine-tetraacetate/iron(III) and ammonium ethylenediamine-tetraacetate/iron(III) are especially preferred. The aminopolycarboxylic acid/iron(III) complexes are useful in both an independent bleaching solution and in a combined bleaching and fixing solution.

A bleaching accelerator and various other kinds of additives as described, e.g., in U.S. Pat. Nos. 3,042,520, 3,893,858, and 3,241,966, Japanese Patent Publication Nos. 8506/70 and 8836/70, West German Pat. Nos. 1,290,812 and 2,059,988, Japanese Patent Application (OPI) Nos. 32736/78, 57831/78, 37418/78, 95630/78, 95631/78, 72623/78, and 65732/78, and *Research Disclosure,* RD No. 17129 (July 1978) may be added to the bleaching or bleaching-fixing solution.

In the fixing bath to be used for the fixing of the present photographic materials, a fixing agent, such as ammonium, sodium, or potassium thiosulfate, is incorporated in an amount of from 30 to 200 g/liter; and in addition thereto, some other additives may be added to the bath, including a stabilizer (such as sulfites and meta-bisulfites), a hardener (such as potassium alum), and a pH buffer (such as acetates, borates, phosphates, and carbonates). The pH value of the fixing solution is generally within the range of from 3 to 10, and preferably from 5 to 9.

After bleaching-fixing or fixing, in general, washing or stabilization is carried out. In the washing or stabilization step, various kinds of known compounds may be added to the processing solution for the purpose of preventing the formation of precipitates in the solution or of reducing the amount of water to be used. For instance, water-softeners such as inorganic phosphoric acids, amino-polycarboxylic acids, organic amino-polyphosphonic acids, or organic phosphoric acids; germicides or fungicides for prevention of the growth of various kinds of bacteria, algae or fungi; metal salts such as magnesium salts, aluminum salts or bismuth salts; surfactants for the purpose of prevention of drying load or uneveness; as well as various kinds of hardeners may optionally be added. Further, the compounds as described in L. E. West, *Photographic Science and Engineering,* Vol. 6, pp. 344–359 (1965) may also be used. In particular, the addition of chelating agents or fungicides is effective.

In the washing step, a counter-current washing with two or more baths is generally performed for the purpose of reducing the amount of water to be used. A multi-stage counter-current stabilization step as described in Japanese Patent Application (OPI) No. 8543/82 may be carried out in place of the washing step. In this step, two to nine counter-current baths are required. To the processing solution of the stabilization bath are added various kinds of compounds for the stabilization of images, in addition to the aforesaid additives. For instance, typical compounds include various kinds of buffers for the regulation of the film pH (e.g., pH of 3 to 9) such as borates, metaborates, borax, phosphates, carbonates, potassium hydroxide, sodium hydroxide, aqueous ammonia, monocarboxylic acids, dicarboxylic acids, and polycarboxylic acids which may be used in combination, as well as aldehydes such as formalin. Further, any other additives may optionally be added, if desired, such as chelating agents (e.g., inorganic phosphoric acids, aminopolycarboxylic acids, organic phosphoric acids, organic phosphonic acids, aminopolyphosphonic acids, phosphonocarboxylic acids), germicides (e.g., benzoisothiazolinones, isothiazolones, 4-thiazolinebenzimidazoles, halogenated phenols, sulfanylamides, benzotriazoles), surfactants, fluorescent whitening agents, hardeners, etc. In the addition of the additives, two or more of the same or different kinds of compounds may be added together.

derivatives, p-alkoxyphenols, p-oxyphenol derivatives, and bisphenols.

Any known methods and known treating solutions, for example, as described in *Research Disclosure,* Vol. 176, pp. 28–30, may be adapted to the photographic treatment of the photographic materials of the present invention. The treatment temperature is generally selected in the range of from 18° C. to 50° C., but the temperature may be lower than 18° C. or higher than 50° C.

Regarding the photographic treatment of the silver halide photographic materials of the present invention, black-and-white development and fixing are carried out for black-and-white photographic materials; color-development, bleaching, and fixing are carried out for color photographic materials; and first development, reversal, color-development, bleaching, and fixing are carried out for color reversal photographic materials.

For the first developer to be used for the development of the present materials, a known developing agent may be used. Usable developing agents are dihydroxybenzenes (such as hydroquinone), 3-pyrazolidones (such as 1-phenyl-3-pyrazolidone), aminophenols (such as N-methyl-p-aminophenol), 1-phenyl-3-pyrazolines, ascorbic acids, and condensed heterocyclic compounds formed by condensation of 1,2,3,4-tetrahydroquinoline ring and indolenine ring (such as those as described in U.S. Pat. No. 4,067,872), and these may be used singly or in the form of a mixture thereof.

The first developer which may be used for the development of the present materials may further contain, if desired, a preservative (such as sulfites and bisulfites), a buffer (such as carbonates, borates, boric acid, and alkanolamines), an alkali agent (such as hydroxides and carbonates), a solubilizing assistant (such as polyethyleneglycols and esters thereof), a pH regulator (such as organic acids, e.g., acetic acid), a sensitizer (such as quaternary ammonium salts), a development accelerator, a surfactant, a toning agent, an anti-foaming agent, a hardener, and a tackifier.

It is necessary to incorporate a compound having an activity as a solvent for silver halides in the first developer to be used for the development of the present materials, and in general, the sulfite (which is added as a preservative, as mentioned above) may fulfill the action as the solvent. Usable sulfites and other silver halide solvents are, for example, KSCN, NaSCN, $K_2SO_3$, $Na_2SO_3$; $K_2S_2O_5$, $Ka_2S_2O_5$, $K_2S_2O_3$, and $Na_2S_2O_3$.

For the purpose of acceleration of the development of the present photographic materials, a development accelerator is used, and, in particular, compounds of the following formula (II) as described in Japanese Patent Application (OPI) No. 63580/82 may be used therefor, singly or in the form of a mixture of two or more thereof, or together with the above-described silver halide solvent.

$$R_{10}(S-R_9)_d-S-R_{10} \quad \text{(II)}$$

wherein $R_9$ represents an alkylene group having from 2 to 10 carbon atoms, which may contain an ether bond(s); $R_{10}$ represents an alkyl group having from 2 to 10 carbon atoms, which may be substituted and may contain an ether bond(s) and/or ester bond(s); d is an integer of from 0 to 3.

If the amount of the silver halide solvent as used is too small, the proceeding of the development is slow. On the other hand, if the amount is too large, the silver halide emulsion is fogged; and therefore, the preferred amount of the solvent to be used is appropriately regulated, and the regulation of the amount may easily be carried out by anyone skilled in the art.

For instance, the amount of $SCN^-$ is preferably from 0.005 to 0.02 mole, and is especially preferably from 0.01 to 0.015 mole, per liter of the developer. The amount of $SO_3^{2-}$ is preferably from 0.05 to 1 mole, and especially preferably from 0.1 to 0.5 mole, per liter of the developer.

In the case that the compound of formula (II) is added to the first developer, the amount thereof is preferably from $5\times10^{-6}$ to $5\times10^{-1}$ mole, and more preferably from $1\times10^{-4}$ to $2\times10^{-1}$ mole, per liter of the developer.

The pH value of the developer thus prepared is selected such that the developer may attain the desired image density and image contrast in the developed material, and in general, the pH value thereof is preferably within the range of from about 8.5 to about 11.5

When the first developer is used in the sensitization treatment of the present photographic material, the treating time is to be prolonged longer than the ordinary processing time (i.e., the time necessary to actualize an indicated sensitivity of the photographic material) by at most up to three times or so. If the treatment is carried out at an elevated temperature the treating time can be reduced.

A known fogging agent may be used in a fogging solution to be used in the reversal step. Usable fogging agents are stannous ion-organic phosphate complexes (U.S. Pat. NO. 3,617,282), stannous ion-organic phosphonocarboxylate complexes (Japanese Patent Publication No. 32616/81), stannous ion-aminopolycarboxylates (British Pat. No. 1,209,050) and boron hydride compounds of these stannous ion-complexes (U.S. Pat. No. 2,984,567), and boron compounds such as heterocyclic aminoboranes (British Pat. No. 1,011,000). The pH value of the fogging bath (reversal bath) may vary in a broad range, from the acidic side to the alkaline side, generally falling within the range of pH from 2 to 12, preferably from 2.5 to 10, and especially preferably from 3 to 9.

The color developer used for the color-development of the present photographic materials, may have, in general, the composition of a conventional color developer containing an aromatic primary amine developing agent. Preferred examples of the aromatic primary amine color-developing agents are p-phenylenediamine derivatives, such as N,N-diethyl-p-phenylenediamine, 2-amino-5-diethylaminotoluene, 2-amino-5-(N-ethyl-N-laurylamino)toluene, 4-[N-ethyl-N-(β-hydroxyethyl-)amino]aniline, 2-methyl-4-[N-ethyl-N-(β-hydroxyethyl)amino]aniline, N-ethyl-N-(β-methanesulfoamidoethyl)-3-methyl-4-aminoaniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline, as well as their salts (such as sulfates, hydrochlorides, sulfites, and p-toluenesulfonates) (as described in U.S. Pat. Nos. 3,656,950 and 3,698,525).

The color developer may contain, in addition to the developing agent, various kinds of compounds which are known as general components in conventional developers, for example, an alkali agent or a buffer agent, such as sodium hydroxide, potassium hydroxide, so- For the film pH-regulation after the processing of the materials, various kinds of ammonium salts are preferably added, such as ammonium chloride, ammonium nitrate, ammonium sulfate, ammonium phosphate, ammonium sulfite, or ammonium thiosulfate.

In the processing of color photographic materials for taking pictures, a washing-stabilization step, which is generally carried out after fixing, may be substituted for the above-mentioned stabilization step and the washing step (for water-economization processing). In this case, if the magenta coupler as used is a 2-equivalent type, the formalin in the stabilization step may be omitted.

The time for the washing and stabilization in accordance with the present invention varies, depending upon the kind of the photographic materials to be processed and the condition in the processing, and in general, it ranges from 20 seconds to 10 minutes and preferably from 20 seconds to 5 minutes.

The color photographic materials of the present invention may contain a color developer therein for the purpose of simplification and acceleration of the processing thereof. For the incorporation of the developer into the materials, various kinds of precursors of color developers are preferably used. For instance, indoaniline-type compounds as described in U.S. Pat. No. 3,342,597; Shiff base-type compounds as described in U.S. Pat. No. 3,342,599 and *Research Disclosure,* RD Nos. 14850 (Aug. 1976) and 15159 (Nov. 1976); aldol compounds as described in Ibid., RD No. 13924 (Nov. 1975); metal salt complexes as described in U.S. Pat. No. 3,719,492; urethane-type comounds as described in Japanese Patent Application (OPI) No. 135628/78; as well as various kinds of base-type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, and 83565/82 may be used for the purpose.

The color photographic materials of the present invention may contain, if desired, various kinds of 1-phenyl-3-pyrazolidones therein for the purpose of the acceleration of the color development. Typical compounds are those as described in Japanese Patent Application (OPI) Nos. 64339/81, 144547/82, 211147/82, 50532/83, 50536/83, 50533/83, 50534/83, 50535/83, and 115438/83.

The processing solutions are used at 10° to 50° C. and generally at 33° to 38° C., but the processing temperature may be higher so as to accelerate the processings and to reduce the processing time, or on the contrary, may be lower so as to improve the image quality and to improve the stability of the processing solution. For the economization of the silver in the photographic materials, the materials may be processed in the presence of a cobalt-intensifier or a hydrogen peroxide-intensifier, as described in West German Pat. No. 2,226,770 or U.S. Pat. No. 3,674,499.

The processing baths may optionally be provided with a heater, a temperature sensor, a liquid level sensor, a circulating pump, a filter, a floating lid and/or a squeezer.

In continuous processing, a replenisher may be introduced into each processing bath so as to prevent the variation of the composition of the processing solution in each bath, whereby constant images may be obtained. The amount of the replenisher may be reduced to a half or less of the standard amount thereof so as to economize the processing cost.

In the case that the photographic materials of the present invention are color papers, these are generally subjected to bleaching-fixing treatment, and the color photographic materials for taking pictures may also be subjected to bleaching-fixing treatment, if desired.

The present invention will be explained in greater detail by reference to the following examples, which, however, are not intended to be interpreted as limiting the scope of the present invention.

EXAMPLE 1

The following layers were provided on a cellulose triacetate film base to form a multi-layer color photographic material (Sample No. 101).

| | |
|---|---|
| 1st layer (anti-halation layer): | |
| Gelatin layer containing | |
| Black colloidal silver | 0.18 g/m$^2$ |
| 2nd layer (intermediate layer): | |
| Gelatin layer containing | |
| 2,5-di-t-pentadecylhydroquinone | 0.18 g/m$^2$ |
| Coupler C-3 | 0.11 g/m$^2$ |
| 3rd layer (1st red-sensitive emulsion layer): | |
| Gelatin layer containing | |
| Silver bromoiodide emulsion (silver iodide: 4 mole %, average grain size: 0.4 μm) | 0.72 g/m$^2$ (coated silver amount) (The same shall apply hereafter.) |
| Sensitizing dye A | $9.0 \times 10^{-5}$ mole per mole of silver |
| Sensitizing dye B | $3.0 \times 10^{-5}$ mole per mole of silver |
| Sensitizing dye C | $4.2 \times 10^{-4}$ mole per mole of silver |
| Sensitizing dye D | $3.0 \times 10^{-5}$ mole per mole of silver |
| Coupler C-4 | 0.093 g/m$^2$ |
| Coupler C-5 | 0.31 g/m$^2$ |
| Coupler C-6 | 0.01 g/m$^2$ |
| 4th layer (2nd red-sensitive emulsion layer): | |
| Gelatin layer containing: | |
| Silver bromoiodide emulsion (silver iodide: 10 mole %, average grain size: 1.0 μm) | 1.2 g/m$^2$ |
| Sensitizing dye A | $7.8 \times 10^{-5}$ mole per mole of silver |
| Sensitizing dye B | $2.2 \times 10^{-5}$ mole per mole of silver |
| Sensitizing dye C | $3.0 \times 10^{-4}$ mole per mole of silver |
| Sensitizing dye D | $2.2 \times 10^{-5}$ mole per mole of silver |
| Coupler C-4 | 0.1 g/m$^2$ |
| Coupler C-5 | 0.061 g/m$^2$ |
| Coupler C-7 | 0.046 g/m$^2$ |
| 5th layer (3rd red-sensitive emulsion layer): | |
| Gelatin layer containing: | |
| Silver bromoiodide emulsion (silver iodide: 10 mole %, average grain size: 1.5 μm) | 1.5 g/m$^2$ |
| Sensitizing dye A | $8.0 \times 10^{-5}$ mole per mole of silver |
| Sensitizing dye B | $2.4 \times 10^{-5}$ mole per mole of silver |
| Sensitizing dye C | $3.3 \times 10^{-5}$ mole per mole of silver |
| Sensitizing D | $2.4 \times 10^{-5}$ mole per mole of silver |
| Coupler C-7 | 0.32 g/m$^2$ |
| Coupler C-16 | 0.001 g/m$^2$ |
| 6th layer (intermediate layer): | |
| Gelatin layer | |
| 7th layer (1st green-sensitive emulsion layer): | |
| Gelatin layer containing: | |
| Silver bromoiodide emulsion | 0.55 g/m$^2$ |

-continued

| | |
|---|---|
| (silver iodide: 5 mole %, average grain size: 0.5 μm) | |
| Sensitizing dye G | $3.8 \times 10^{-4}$ mole per mole of silver |
| Sensitizing dye E | $1.5 \times 10^{-4}$ mole per mole of silver |
| Coupler C-8 | 0.29 g/m$^2$ |
| Coupler C-3 | 0.04 g/m$^2$ |
| Coupler C-9 | 0.055 g/m$^2$ |
| Coupler C-10 | 0.058 g/m$^2$ |
| 8th layer (2nd green-sensitive emulsion layer): | |
| Gelatin layer containing | |
| Silver bromoiodide emulsion (silver iodide: 6 mole %, spherical grains: average grain size 1.2 μm) | 1.0 g/m$^2$ |
| Sensitizing dye G | $2.7 \times 10^{-4}$ mole per mole of silver |
| Sensitizing dye E | $1.1 \times 10^{-4}$ mole per mole of silver |
| Coupler C-8 | 0.25 g/m$^2$ |
| Coupler C-3 | 0.013 g/m$^2$ |
| Coupler C-9 | 0.009 g/m$^2$ |
| Coupler C-10 | 0.011 g/m$^2$ |
| 9th layer (3rd green-sensitive emulsion layer): | |
| Gelatin layer containing | |
| Silver bromoiodide emulsion (silver iodide: 8 mole %, spherical grains: average grain size 1.8 μm) | 2.0 g/m$^2$ |
| Sensitizing dye G | $3.0 \times 10^{-4}$ mole per mole of silver |
| Sensitizing dye E | $1.2 \times 10^{-4}$ mole per mole of silver |
| Coupler C-3 | 0.008 g/m$^2$ |
| Coupler C-11 | 0.05 g/m$^2$ |
| Coupler C-17 | 0.001 g/m$^2$ |
| 10th layer (yellow-filter layer): | |
| Gelatin layer containing | |
| Yellow colloidal silver | 0.04 g/m$^2$ |
| 2,5-di-t-pentadecylhydroquinone | 0.031 g/m$^2$ |
| 11th layer (1st blue-sensitive emulsion layer): | |
| Gelatin layer containing | |
| Silver bromoiodide emulsion | 0.32 g/m$^2$ |

-continued

| | |
|---|---|
| (silver iodide: 5 mole %, average grain size: 0.4 μm) | |
| Coupler C-12 | 0.68 g/m$^2$ |
| Coupler C-13 | 0.03 g/m$^2$ |
| Coupler C-18 | 0.015 g/m$^2$ |
| 12th layer (2nd blue-sensitive emulsion layer): | |
| Gelatin layer containing | |
| Silver bromoiodide emulsion (silver iodide: 10 mole %, average grain size: 1.0 μm) | 0.29 g/m$^2$ |
| Sensitizing dye F | $2.2 \times 10^{-4}$ mole per mole of silver |
| Coupler C-12 | 0.22 g/m$^2$ |
| 13th layer (fine grain-containing emulsion layer): | |
| Gelatin layer containing | |
| Silver bromoiodide emulsion (silver iodide: 2 mole %, average grain size: 0.15 μm) | 0.4 g/m$^2$ |
| 14th layer (3rd blue-sensitive emulsion layer): | |
| Gelatin layer containing | |
| Silver bromoiodide emulsion (silver iodide: 14 mole %, average grain size: 2.3 μm) | 0.79 g/m$^2$ |
| Sensitizing dye F | $2.3 \times 10^{-4}$ mole per mole of silver |
| Coupler C-12 | 0.19 g/m$^2$ |
| Coupler C-14 | 0.001 g/m$^2$ |
| 15th layer (1st protective layer): | |
| Gelatin layer containing | |
| Ultraviolet absorbent C-1 | 0.14 g/m$^2$ |
| Ultraviolet absorbent C-2 | 0.22 g/m$^2$ |
| 16th layer (2nd protective layer): | |
| Gelatin layer containing | |
| Polymethyl methacrylate grains (diameter: 1.5 μm) | 0.05 g/m$^2$ |

In each layer, gelatin hardener (C-15) and a surfactant were incorporated, in addition to the above-mentioned components. Thus, a sample No. 101 was obtained.

Compounds as used in the preparation of this sample were as follows.

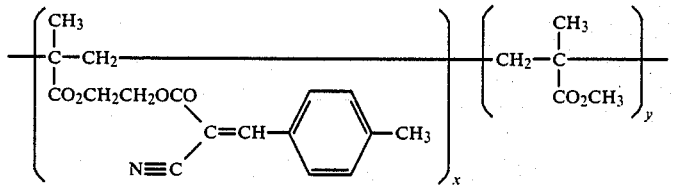

x/y = 7/3 (by weight)

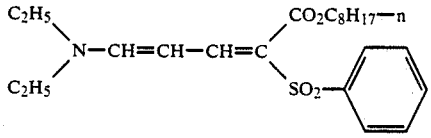

-continued
C-3
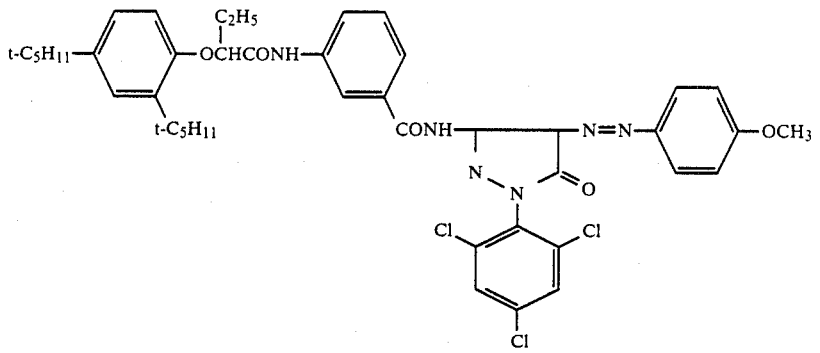
C-4
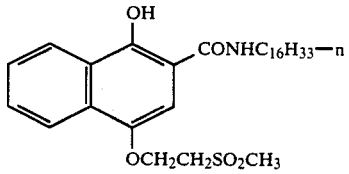
C-5
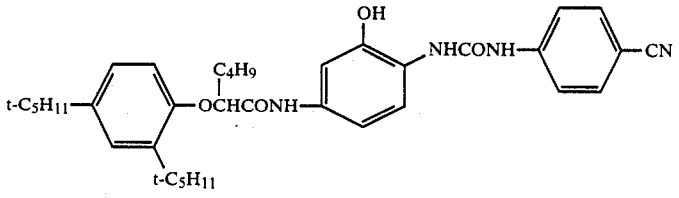
C-6
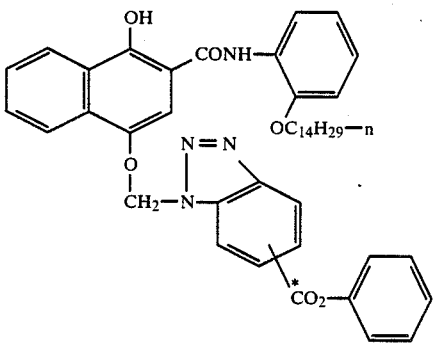
(*bonded at 5- or 6-position of the benzotriazole ring)
C-7
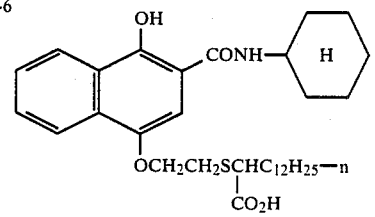
C-8
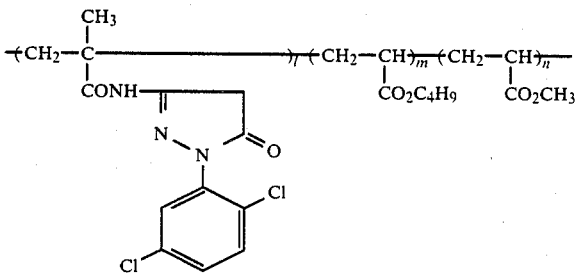
l/m/n = 2/1/1 (by weight)

-continued
C-9
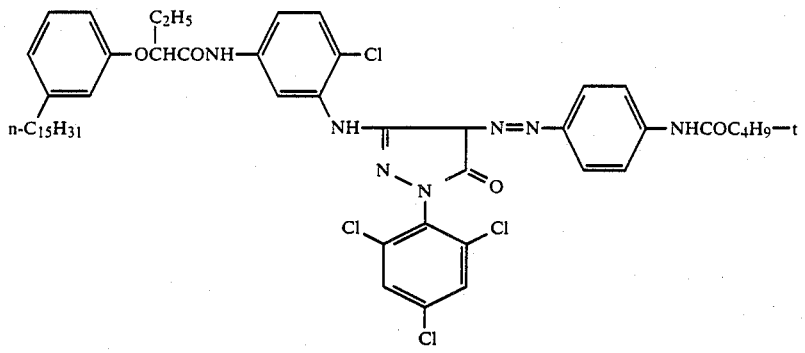
C-10
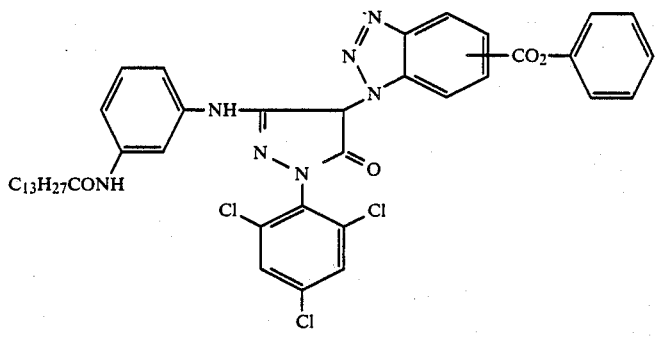
C-11
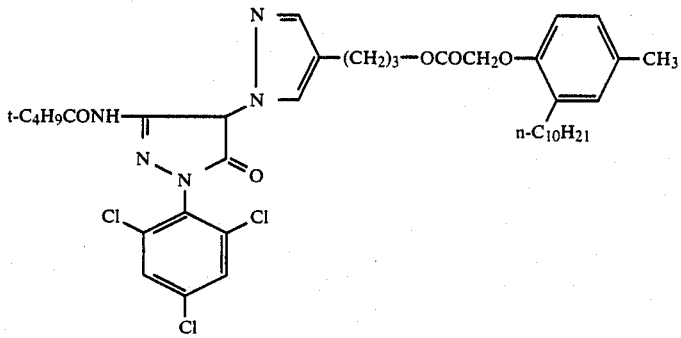
C-12
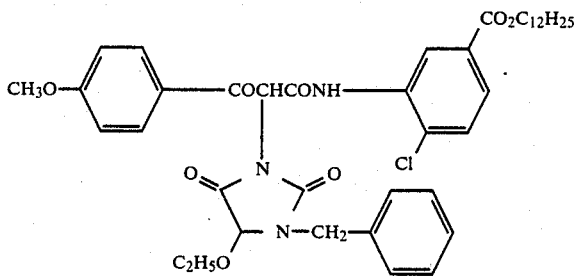
C-13
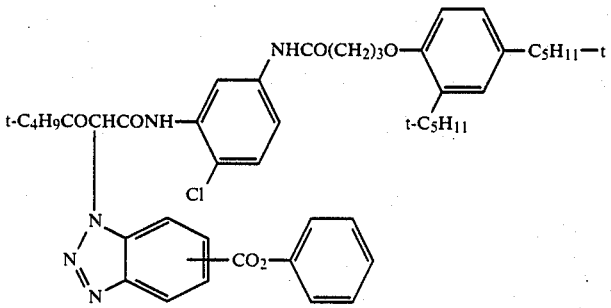

-continued
C-14
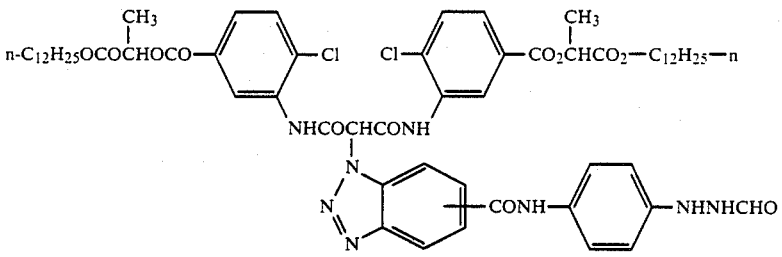
C-15
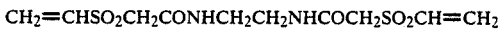
C-16
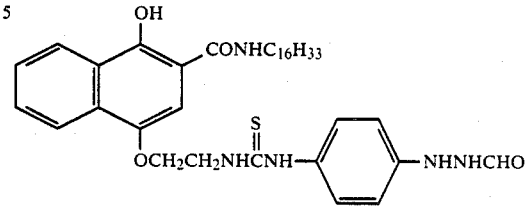
C-17
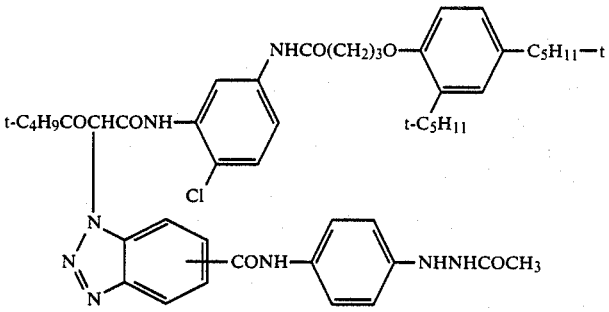
C-18
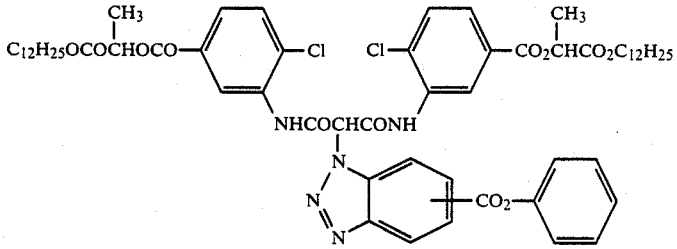
Sensitizing dye A
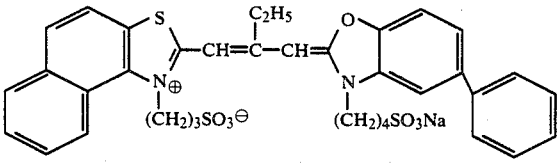
Sensitizing dye B
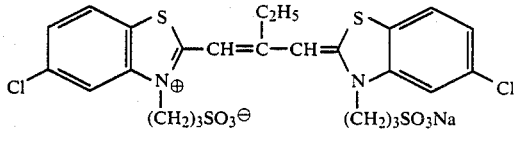
Sensitizing dye C
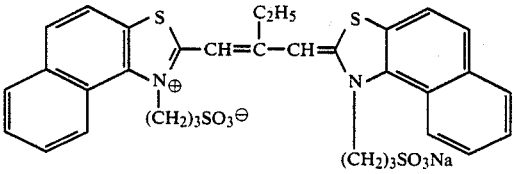
Sensitizing dye D
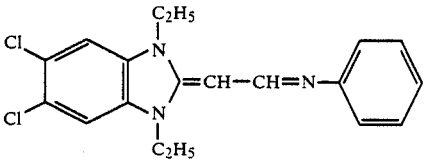
Sensitizing dye E
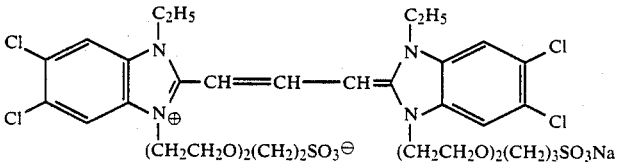

-continued

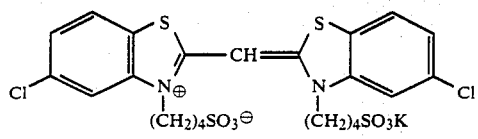

Sensitizing dye F

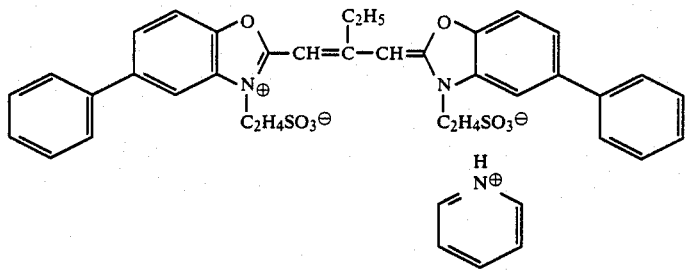

Sensitizing dye G

Preparation of Sample No. 102:

Sample No. 102 was prepared in the same manner as Sample No. 101, with the exception that a substantially non-light-sensitive silver bromoiodide emulsion (silver iodide: 1 mole%, average grain size: 0.1 μm, coated silver amount: 0.3 g/m$^2$) was added to the 16th layer of Sample No. 101.

Preparation of Sample Nos. 103, 105, 107, 109, and 110:

Sample Nos. 103, 105, 107, 109, and 110 were prepared in the same manner as Sample No. 101, with the exception that the compound as shown in the following Table 1 was added to the 3rd and 4th layers of Sample No. 101, the added amount being shown in the same table.

Preparation of Sample Nos. 104, 106, 108, and 111 through 121:

Sample Nos. 104, 106, 108, and 111 through 121 were prepared in the same manner as Sample No. 102, with the exception that the compound as shown in Table 1 was added to the 3rd and 4th layers of Sample No. 102, the added amount being shown in the same table.

A part of each of these samples was subjected to red wedge-exposure and the other to white wedge-exposure (with red+green+blue light). The amount of red exposure in the white wedge-exposure was the same as that of the exposure in the red wedge-exposure.

Each of the samples thus exposed was subjected to color-development with two kinds of color developers (A) and (B).

The development treatment was carried out at 38° C., as explained below in detail.

The cyan density as obtained by the red light-exposure was compared with that as obtained by the white light-exposure. It can be said that the interimage effect is larger if the difference in the amounts of the exposure (for attaining the cyan density of 0.6) therebetween (=Δ log E) is larger.

The sharpness of the formed image was evaluated on the basis of MTF (modulation transfer function) value. That is, each sample was exposed to light through a pattern for MTF measurement, and subjected to the color development processing. The thus-processed samples were measured with a microdensitometer, and MTF values of these samples were calculated. The "MTF value" is described in *Theory of the Photographic Process*, 4th edition, p. 604, Macmillan Publishing Co., Inc. (1977). Sharpness was represented by MTF value of 10 line/mm.

| | |
|---|---|
| 1. Color development | 3 min. 15 sec. |
| 2. Bleaching | 6 min. 30 sec. |
| 3. Washing with water | 3 min. 15 sec. |
| 4. Fixing | 6 min. 30 sec. |
| 5. Washing with water | 3 min. 15 sec. |
| 6. Stabilization | 3 min. 15 sec. |

The composition of the treating solution used in each step was as follows:

| | |
|---|---|
| Color Developer (A): | |
| Sodium nitrilotriacetate | 1.0 g |
| Sodium sulfite | 4.0 g |
| Sodium carbonate | 30.0 g |
| Potassium bromide | 1.4 g |
| Hydroxylamine.sulfate | 2.4 g |
| 4-(N—ethyl-N—β-hydroxyethylamino)-2-methylaniline.sulfate | 4.5 g |
| Water to make | 1.0 liter |
| Color Developer (B): | |
| Sodium nitrilotriacetate | 1.0 g |
| Sodium sulfite | 4.0 g |
| Sodium carbonate | 30.0 g |
| Potassium bromide | 1.4 g |
| Potassium iodide | 10 mg |
| Hydroxylamine.sulfate | 2.4 g |
| 4-(N—ethyl-N—β-hydroxyethylamino)-2-methylaniline.sulfate | 4.5 g |
| Water to make | 1.0 liter |
| Bleaching Solution | |
| Ammonium bromide | 160.0 g |
| Aqueous ammonia (28%) | 25.0 ml |
| Sodium ethylenediamine-tetraacetate/iron complex | 130.0 g |
| Glacial acetic acid | 14.0 ml |
| Water to make | 1.0 liter |
| Fixing solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1.0 liter |
| Stabilizing solution: | |
| Formalin (37 wt % formaldehyde solution) | 8.0 ml |
| Water to make | 1.0 liter |

TABLE 1

| Sample No. | Additive to 3rd and 4th layers | Amount of additive per layer (mole/m$^2$) | Coated silver amount in 16th layer | Δlog E (Cyan density D = 0.6) | | MTF of cyan image (10 line/mm) | |
|---|---|---|---|---|---|---|---|
| | | | | Developer (A) | Developer (B) | Developer (A) | Developer (B) |
| 101* | — | — | — | 0.23 | 0.18 | 0.42 | 0.39 |
| 102* | — | — | 0.3 g/m$^2$ | 0.23 | 0.20 | 0.42 | 0.40 |
| 103* | Compound A | $5 \times 10^{-6}$ | — | 0.24 | 0.20 | 0.43 | 0.40 |
| 104* | " | " | 0.3 g/m$^2$ | 0.24 | 0.21 | 0.43 | 0.40 |
| 105* | Compound B | " | — | 0.25 | 0.21 | 0.44 | 0.41 |
| 106* | " | " | 0.3 g/m$^2$ | 0.25 | 0.22 | 0.44 | 0.42 |
| 107* | Compound C | " | — | 0.24 | 0.20 | 0.43 | 0.40 |
| 108* | " | " | 0.3 g/m$^2$ | 0.24 | 0.20 | 0.43 | 0.40 |
| 109* | (3) | " | — | 0.46 | 0.38 | 0.61 | 0.56 |
| 110* | (4) | " | — | 0.44 | 0.35 | 0.58 | 0.53 |
| 111 | (3) | " | 0.3 g/m$^2$ | 0.46 | 0.44 | 0.61 | 0.60 |
| 112 | (4) | " | " | 0.44 | 0.42 | 0.59 | 0.58 |
| 113 | (6) | " | " | 0.45 | 0.43 | 0.60 | 0.58 |
| 114 | (11) | " | " | 0.42 | 0.40 | 0.58 | 0.57 |
| 115 | (20) | " | " | 0.44 | 0.42 | 0.60 | 0.58 |
| 116 | (23) | " | " | 0.43 | 0.40 | 0.59 | 0.57 |
| 117 | (22) | " | " | 0.44 | 0.42 | 0.59 | 0.58 |
| 118 | (44) | " | " | 0.46 | 0.45 | 0.61 | 0.60 |
| 119 | (45) | " | " | 0.44 | 0.43 | 0.60 | 0.58 |
| 120 | (46) | " | " | 0.42 | 0.40 | 0.58 | 0.57 |
| 121 | (50) | " | " | 0.44 | 0.42 | 0.60 | 0.58 |

(Note)
*Comparative sample

Compound A

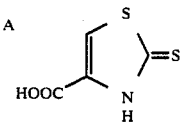

Compound B

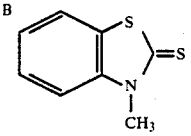

Compound C

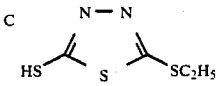

The above results prove the fact that the samples of the present invention have better interimage effects and higher sharpness than the comparative samples, and that the variation of the photographic characteristics of the samples of the present invention is small, when treated with Developer (A) and Developer (B).

EXAMPLE 2

The following 1st to 12th layers were provided on a cellulose triacetate film base, to form Sample No. 201.

1st layer (anti-halation layer):

Gelatin layer containing black colloidal silver

2nd layer (gelatin intermediate layer):

2,5-di-t-octylhydroquinone was dissolved in 100 ml of dibutyl phthalate and 100 ml of ethyl acetate, and the solution was stirred at a high speed with 1 kg of 10% gelatin aqueous solution to obtain an emulsion. 2 kg of this emulsion was blended with 1.5 kg of 10% gelatin together with 1 kg of a fine grain-containing (but not chemically-sensitized) emulsion (grain size: 0.06 μm, 1 mole-silver bromoiodide emulsion), and the resulting mixture was coated to form a film having a dry thickness of 2 μm. (Coated silver amount: 0.4 g/m$^2$)

3rd layer (red-sensitive emulsion layer of low sensitivity):

100 g of 2-(heptafluorobutylamido)-5-[2'-(2'',4''-di-t-aminophenoxy)butylamido]-phenol (=cyan coupler) was dissolved in 100 ml of tricresyl phosphate and 100 ml of ethyl acetate, and the solution was stirred at a high speed with 1 kg of 10% gelatin aqueous solution to obtain an emulsion. 500 g of this emulsion was blended with 1 kg of a red-sensitive silver bromoiodide emulsion (containing 70 g of silver and 60 g of gelatin, with the iodine content being 4 mole%), and the resulting mixture was coated to form a film having a dry thickness of 1 μm. (Coated silver amount: 0.5 g/m$^2$)

4th layer (red-sensitive emulsion layer of high sensitivity):

100 g of 2-(heptafluorobutylamido)-5-[2'-(2'',4''-di-t-aminophenoxy)butylamido]-phenol (cyan coupler) was dissolved in 100 ml of tricresyl phosphate and 100 ml of ethyl acetate, and the solution was stirred at a high speed with 1 kg of 10% gelatin aqueous solution, to obtain an emulsion. 1000 g of this emulsion was blended with 1 kg of a red-sensitive silver bromoiodide emulsion (containing 70 g of silver and 60 g of gelatin, with the iodine content being 2.5 mole%), and the resulting mixture was coated to form a film having a dry thickness of 2.5 μm. (Coated silver amount: 0.7 g/m$^2$)

5th layer (intermediate layer):

2,5-di-t-octyl-hydroquinone was dissolved in 100 ml of dibutyl phthalate and 100 ml of ethyl acetate, and the solution was stirred at a high speed with 1 kg of 10% gelatin aqueous solution. The obtained emulsion (1000 g) was blended with 1 kg of 10% gelatin, and the resulting mixture was coated to form a film having a dry thickness of 1 μm.

6th layer (green-sensitive emulsion layer of low sensitivity):

In the same manner as the emulsion of the 3rd layer, with the exception that 1-(2,4,6-trichlorophenyl)-3-[3-(2,4-di-t-amylphenoxyacetamido)benzamido]-5-pyrazolone (=magenta coupler) was used instead of the cyan coupler in the 3rd layer emulsion, and an emulsion was thereby obtained. 300 g of the emulsion thus obtained was blended with 1 kg of green-sensitive silver bromoiodide emulsion (containing 70 g of silver and 60 g of gelatin, with the iodine content being 3 mole%), and the resulting mixture was coated to form a film having a dry film thickness of 1.3 μm. (Coated silver amount: 0.7 g/m²)

7th layer (green-sensitive emulsion layer of high sensitivity):

In the same manner as the emulsion of the 3rd layer, with the exception that 1-(2,4,6-trichlorophenyl)-3-[3-(2,4-di-t-amylphenoxyacetamido)benzamide]-5-pyrazolone (magenta coupler) was used instead of the cyan coupler in the 3rd layer emulsion, an emulsion was obtained. 1000 g of the emulsion thus obtained was blended with 1 kg of a green-sensitive silver bromoiodide emulsion (containing 70 g of silver and 60 g of gelatin, with the iodine content being 2.5 mole%), and the resulting mixture was coated to form a film having dry thickness of 3.5 μm. (Coated silver amount: 0.8 g/m²)

8th layer (yellow filter layer):

An yellow colloidal silver-containing emulsion was coated to form a film having a dry film thickness of 1 μm.

9th layer (blue-sensitive emulsion layer of low sensitivity):

In the same manner as the emulsion of the 3rd layer, with the exception that α-(pivaloyl)-α-(1-benzyl-5-ethoxy-3-hydantoinyl)-2-chloro-5-dodecyloxycarbonylacetanilide (yellow coupler) was used instead of the cyan coupler in the 3rd layer emulsion, an emulsion was obtained. 1000 g of the emulsion thus obtained was blended with 1 kg of a blue-sensitive silver bromoiodide emulsion (containing 70 g of silver and 60 g of gelatin, with the iodine content being 2.5 mole%), and the resulting mixture was coated to form a film having a dry thickness of 1.5 μm. (Coated silver amount: 0.6 g/m²)

10th layer (blue-sensitive emulsion layer of high sensitivity):

In the same manner as the emulsion of the 3rd layer, with the exception that α-(pivaloyl)-α-(1-benzyl-5-ethoxy-3-hydantoinyl)-2-chloro-5-dodecyloxycarbonylacetanilide (yellow coupler) was used instead of the cyan coupler in the 3rd layer emulsion, an emulsion was obtained. 1000 g of the emulsion thus obtained was blended with 1 kg of a silver bromoiodide grain-containing emulsion (containing 70 g of silver and 60 g of gelatin, with the iodine content being 2.5 mole%), and the resulting mixture was coated to form a film having a dry thickness of 3 μm. (Coated silver amount: 1.1 g/m²)

11th layer (2nd protective layer):

1 kg of the ultraviolet absorbent (C-1)-containing emulsion (as used in Example 1) was blended with 1 kg of 10% gelatin, and the resulting mixture was coated to form a film having a dry thickness of 2 μm.

12th layer (1st protective layer):

A gelatin aqueous solution containing polymethyl methacrylate grains (diameter: 1.5 μm, coated amount: 0.05 g/m²) was coated to form a film having a dry thickness of 0.8 μm.

In each layer, gelatin hardener (C-15) and a surfactant were incorporated.

Preparation of Sample No. 202:

Sample No. 202 was prepared in the same manner as Sample No. 201, with the exception that a surface-fogged grain emulsion (grain size: 0.1 μm, 1 mole% silver bromoiodide emulsion, coated silver amount: 0.2 g/m²) was incorporated in the 12th layer of Sample No. 201.

Preparation of Sample Nos. 203, 205, 207, 209, and 210:

Sample Nos. 203, 205, 207, 209, and 210 were prepared in the same manner as Sample No. 201, with the exception that the compound as shown in the following Table 2 was added to the 3rd and 6th layers of Sample No. 201, the added amount being shown in Table 2.

Preparation of Sample Nos. 204, 206, 208, and 211 through 215:

Sample Nos. 204, 206, 208, and 211 through 215 were prepared in the same manner as Sample No. 202, with the exception that the compound as shown in Table 2 was added to the 3rd and 6th layers of Sample No. 202, the added amount being shown in Table 2.

Preparation of Sample Nos. 216 and 217:

Sample Nos. 216 and 217 were prepared in the same manner as Sample No. 202, with the exception that the compound as shown in Table 2 was added to the 2nd and 5th layers of Sample No. 202, the added being shown in Table 2.

A part of each of these samples was subjected to red wedge-exposure and green wedge-exposure separately, and the other was subjected to white wedge-exposure (with red+green+blue light). The amount of each of the red-exposure and the green-exposure in the white wedge-exposure was the same as that of the exposure in the red wedge-exposure and the exposure in the green wedge-exposure, respectively.

These samples thus exposed were developed as follows:

| Step | Time | Temperature |
|---|---|---|
| 1st development | 6 min. | 38° C. |
| Washing with water | 2 min. | " |
| Reversal | 2 min. | " |
| Color development | 6 min. | " |
| Compensation | 2 min. | " |
| Bleaching | 6 min. | " |
| Fixing | 4 min. | " |
| Washing with water | 4 min. | " |
| Stabilization | 1 min. | room temperature |
| Drying | | |

The composition of each processing solution was as follows:

| | |
|---|---|
| 1st Developer (C): | |
| Water | 700 ml |
| Pentasodium nitrilo-N,N,N—trimethylene-phosphonate | 3 g |
| Sodium sulfite | 20 g |
| Hydroquinone monosulfonate | 30 g |
| Sodium carbonate (mono-hydrate) | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml |
| 1st Developer (D): | |
| Water | 700 ml |
| Pentasodium nitrilo-N,N,N—trimethylene- | 3 g |

-continued

| | |
|---|---|
| phosphonate | |
| Hydroquinone monosulfonate | 30 g |
| Sodium carbonate (mono-hydrate) | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 20 ml |
| Water to make | 1000 ml |
| Reversing solution: | |
| Water | 700 ml |
| Pentasodium nitrilo-N,N,N—trimethylene-phosphonate | 3 g |
| Stannous chloride (di-hydrate) | 1 g |
| P-aminophenol | 0.1 g |
| Sodium hydroxide | 8 g |
| Glacial acetic acid | 15 ml |
| Water to make | 1000 ml |
| Color developer: | |
| Water | 700 ml |
| Pentasodium nitrilo-N,N,N—trimethylene-phosphonate | 3 g |
| Sodium sulfite | 7 g |
| Sodium tertiary phosphate (12-hydrate) | 36 g |
| Potassium bromide | 1 g |
| Potassium iodide (0.1% solution) | 90 ml |
| Sodium hydroxide | 3 g |
| Citrazinic acid | 1.5 g |
| N—ethyl-N—(β-methanesulfonamidoethyl)-3-methyl-4-aminoaniline.sulfate | 11 g |
| Ethylenediamine | 3 g |
| Water to make | 1000 ml |

-continued

| | |
|---|---|
| Sodium ethylenediamine-tetraacetate (di-hydrate) | 2 g |
| Ammonium ethylenediamine-tetraacetate/iron(III) (di-hydrate) | 120 g |
| Potassium bromide | 100 g |
| Water to make | 1000 ml |
| Fixing solution: | |
| Water | 800 ml |
| Sodium thiosulfate | 80 g |
| Sodium sulfite | 5 g |
| Sodium bisulfite | 5 g |
| Water to make | 1000 ml |
| Stabilizer solution | |
| Water | 800 ml |
| Formalin (37 wt % formaldehyde solution) | 5.0 ml |
| Fuji Driwel (surfactant made by Fuji Photo Film Co., Ltd.) | 5.0 ml |
| Water to make | 1000 ml |

Each sample as exposed was developed with the 1st Developer (C) and the 1st Developer (D), and the cyan density as obtained by the red light-exposure was compared with that as obtained by the white light-exposure. The difference in the amounts of the exposure (for attaining the cyan density of 1.0) therebetween (=Δ log E) was measured.

In the case of the other green light-exposure, the data of Δ log E were obtained as well.

The results are shown in the following Table 2.

TABLE 2

| Sample No. | Additive | Added layer | Amount of additive per layer (g/m²) | Coated silver amount in 12th layer (g/m²) | Δlog E (Cyan density D = 1.0) | | Δlog E (Magenta density D = 1.0) | |
|---|---|---|---|---|---|---|---|---|
| | | | | | Developer (C) | Developer (D) | Developer (C) | Developer (D) |
| 201* | — | — | — | — | 0.25 | 0.17 | 0.15 | 0.09 |
| 202* | — | — | — | 0.2 | 0.25 | 0.22 | 0.15 | 0.12 |
| 203* | Compound A | 3rd layer, 6th layer | $3 \times 10^{-6}$ | — | 0.28 | 0.20 | 0.17 | 0.11 |
| 204* | " | 3rd layer, 6th layer | " | 0.2 | 0.28 | 0.25 | 0.17 | 0.14 |
| 205* | Compound B | 3rd layer, 6th layer | " | — | 0.29 | 0.22 | 0.17 | 0.11 |
| 206* | " | 3rd layer, 6th layer | " | 0.2 | 0.29 | 0.26 | 0.17 | 0.14 |
| 207* | Compound C | 3rd layer, 6th layer | " | — | 0.29 | 0.21 | 0.18 | 0.11 |
| 208* | " | 3rd layer, 6th layer | " | 0.2 | 0.29 | 0.25 | 0.18 | 0.15 |
| 209* | (3) | 3rd layer, 6th layer | " | — | 0.47 | 0.38 | 0.40 | 0.32 |
| 210* | (20) | 3rd layer, 6th layer | " | 0.2 | 0.45 | 0.37 | 0.38 | 0.30 |
| 211 | (3) | 3rd layer, 6th layer | " | 0.2 | 0.47 | 0.45 | 0.40 | 0.37 |
| 212 | (20) | 3rd layer, 6th layer | " | " | 0.45 | 0.42 | 0.38 | 0.36 |
| 213 | (8) | 3rd layer, 6th layer | " | " | 0.43 | 0.40 | 0.37 | 0.34 |
| 214 | (16) | 3rd layer, | " | " | 0.46 | 0.42 | 0.39 | 0.36 |
| 215 | (21) | 3rd layer, | " | " | 0.45 | 0.42 | 0.38 | 0.35 |
| 216 | (3) | 2nd layer, 5th layer | " | " | 0.42 | 0.39 | 0.35 | 0.32 |
| 217 | (20) | 2nd layer, 5th layer | " | " | 0.40 | 0.37 | 0.33 | 0.30 |

(Note) *Comparative sample

| | |
|---|---|
| Compensating solution: | |
| Water | 700 ml |
| Sodium sulfite | 12 g |
| Sodium ethylenediamine-tetraacetate (di-hydrate) | 8 g |
| Thioglycerin | 0.4 ml |
| Glacial acetic acid | 3 ml |
| Water to make | 1000 ml |
| Bleaching solution: | |
| Water | 800 ml |

The above results prove the fact that the samples of the present invention have better interimage effect than the comparative samples and that the variation of the photographic characteristics of the samples of the present invention, when developed with Developer (C) and Developer (D), is little.

EXAMPLE 3

Preparation of Sample No. 301:

Sample No. 301 was prepared in the same manner as Sample No. 201.

Preparation of Sample No. 302:

Sample No. 302 was prepared in the same manner as Sample No. 301, with the exception that a non-light-sensitive silver halide emulsion (grain size: 0.1 μm, 0.5 mole% silver bromoiodide emulsion, coated silver amount: 0.2 g/m$^2$) was incorporated in the 12th layer of Sample No. 301.

Preparation of Sample No. 303:

Sample No. 303 was prepared in the same manner as Sample No. 301, with the exception that a surface-fogged silver halide grain-containing emulsion (grain size: 0.1 μm, 0.5 mole% silver bromoiodide emulsion, coated silver amount: 0.2 g/m$^2$) was incorporated in the 12th layer of Sample No. 301.

Preparation of Sample No. 304:

Sample No. 304 was prepared, in which the 1st to 11th layers were the same as those of Sample No. 301, and the following 12th layer and 13th layer were coated thereover.

12th layer:

A gelatin aqueous solution containing a surface-fogged silver halide emulsion (grain size: 0.1 μm, 0.5 mole% silver bromoiodide emulsion, coated silver amount: 0.2 g/m$^2$) was coated to form a film having a dry thickness of 0.4 μm.

13th layer:

A gelatin layer containing polymethyl methacrylate grains (diameter: 1.5 μm, coated amount: 0.05 g/m$^2$) was coated.

In each layer were incorporated the gelatin hardener (C-15) and a surfactant.

Preparation of Sample No. 305:

Sample No. 305 was prepared in the same manner as Sample No. 301, with the exception that a surface-fogged silver halide grain-containing emulsion (grain size: 0.1 μm, 0.5 mole% silver bromoiodide emulsion, coated silver amount: 0.2 g/m$^2$) was incorporated in the 11th layer of Sample No. 301.

Preparation of Sample Nos. 306 through 310:

Sample Nos. 306 through 310 were prepared in the same manner as Sample Nos. 301 through 305, with the exception that Compound (3) was added to the 3rd, 6th, and 7th layers of Sample Nos. 301–305 each in an amount of $2\times10^{-6}$ mole/m$^2$, respectively.

Preparation of Sample No. 311:

Sample No. 311 was prepared in the same manner as Sample No. 309, with the exception that a non-light-sensitive emulsion was used in the 12th layer instead of the surface-fogged emulsion in Sample No. 309.

Preparation of Sample No. 312:

Sample No. 312 was prepared in the same manner as Sample No. 308, with the exception that an internally-fogged emulsion was used in the 12th layer instead of the surface-fogged emulsion in Sample No. 308. (Internally-fogged emulsion: Cores of the surface-fogged grains in Sample No. 308 were covered with a shell of silver bromide having a thickness of 100 Å to obtain an internally-fogged silver bromoiodide emulsion. Coated amount: 0.2 g/m$^2$)

These Sample Nos. 301 through 312 were treated for exposure and development in the same manner as Example 2.

TABLE 3

| Sample No. | Additive to 3rd, 6th, & 7th layers | Amount of additive per layer (mole/m$^2$) | Number of protective layers | Silver halide emulsion in protective layer | Δlog E (Cyan density D = 1.0) | | Δlog E (Magenta density D = 1.0) | |
|---|---|---|---|---|---|---|---|---|
| | | | | | Developer (C) | Developer (D) | Developer (C) | Developer (D) |
| 301* | — | — | 2 | — | 0.25 | 0.17 | 0.15 | 0.09 |
| 302* | — | — | 2 | Non-light-sensitive emulsion in 12th layer | 0.25 | 0.21 | 0.15 | 0.12 |
| 303* | — | — | 2 | Surface-fogged emulsion in 12th layer | 0.25 | 0.21 | 0.15 | 0.12 |
| 304* | — | — | 3 | Surface-fogged emulsion in 12th layer | 0.25 | 0.22 | 0.15 | 0.12 |
| 305* | — | — | 2 | Surface-fogged emulsion in 11th layer | 0.25 | 0.21 | 0.15 | 0.12 |
| 306* | (3) | $2\times10^{-6}$ | 2 | — | 0.45 | 0.36 | 0.37 | 0.29 |
| 307 | (3) | " | 2 | Non-light-sensitive emulsion in 12th layer | 0.45 | 0.43 | 0.38 | 0.35 |
| 308 | (3) | " | 2 | Surface-fogged emulsion in 12th layer | 0.46 | 0.42 | 0.37 | 0.34 |
| 309 | (3) | " | 3 | Surface-fogged emulsion in 12th layer | 0.45 | 0.42 | 0.37 | 0.33 |
| 310 | (3) | " | 2 | Surface-fogged emulsion in 11th layer | 0.45 | 0.42 | 0.38 | 0.35 |
| 311 | (3) | " | 3 | Non-light-sensitive emulsion in 12th layer | 0.46 | 0.43 | 0.37 | 0.34 |
| 312 | (3) | " | 2 | Internally-fogged emulsion in 12th layer | 0.45 | 0.42 | 0.37 | 0.33 |

(Note) *Comparative sample

The above results prove the fact that the samples of the present invention have better interimage effect than the comparative samples and that the variation of the photographic characteristics of the samples of the present invention, when developed with Developer (C) and Developer (D), is small.

EXAMPLE 4

Potassium bromide, potassium iodide, and silver nitrate were added to a gelatin aqueous solution, while vigorously stirring, to obtain a silver bromoiodide emulsion having an average grain size of 0.6 μm (AgI: 3 mole%), and this was, after desalting, subjected to optimum gold/sulfur sensitization with chloroauric acid and sodium thiosulfate, to obtain a silver bromoiodide emulsion (A).

In the same manner, an emulsion (B) (average grain size: 1.2 μm, AgI: 3 mole%) was prepared.

The following layers were provided on a cellulose triacetate film base, to form a black-and-white photographic material.

| | |
|---|---|
| 1st layer (silver halide emulsion layer of low sensitivity): | |
| Emulsion (A) | (coated silver amount: 1 g/m$^2$) |
| 2nd layer (silver halide emulsion layer of high sensitivity): | |
| Emulsion (B) | (coated silver amount: 2.5 g/m$^2$) |
| 3rd layer (protective layer): | |
| Gelatin | (1.3 g/m$^2$) |
| Polymethyl methacrylate grains (diameter: 1.5 μm) | (0.05 g/m$^2$) |

In each layer were incorporated Gelatin Hardener (C-15), a surfactant, and a tackifier (sodium polystyrenesulfonate), in addition to the above components. The sample thus prepared was called Sample No. 401.

Preparation of Sample No. 402:

Sample No. 402 was prepared in the same manner as Sample No. 401, with the exception that a non-light-sensitive silver halide emulsion (silver bromoiodochloride having a grain size of 0.1 μm and containing 0.5 mole% silver iodide and 5 mole% silver chloride, coated silver amount: 0.1 g/m$^2$) was incorporated in the 3rd layer of Sample No. 401.

Preparation of Sample Nos. 403, 405, and 406:

Sample Nos. 403, 405, and 406 were prepared in the same manner as Sample No. 401, with the exception that the compound as shown in the following Table 4 was added to the 1st layer of Sample No. 401, each in an amount of $1\times10^{-5}$ mole/m$^2$.

Preparation of Sample Nos. 404, 407, and 408:

Sample Nos. 404, 407, and 408 were prepared in the same manner as Sample No. 402, with the exception that the compound as shown in the following Table 4 was added to the 1st layer of Sample No. 402, each in an amount of $1\times10^{-5}$ mole/m$^2$.

Each of these samples was exposed through a pattern for the measurement of the graininess or through a pattern for the measurement of the sharpness, and then developed as described below using the following solutions.

| | |
|---|---|
| Developer (E): | |
| Methol | 2 g |
| Sodium sulfite | 100 g |
| Hydroquinone | 5 g |
| Borax.5$H_2O$ | 1.53 g |
| Water to make | 1 liter |
| Developer (F): | |
| Methol | 2 g |
| Sodium sulfite | 100 g |
| Hydroquinone | 5 g |
| Borax.5$H_2O$ | 1.53 g |
| Potassium iodide (0.1%) | 5 ml |
| Water to make | 1 liter |
| Fixing solution: | |
| Ammonium thiosulfate | 200 g |
| Sodium sulfite (anhydride) | 20 g |
| Boric acid | 8 g |
| Disodium ethylenediamine-tetraacetate | 0.1 g |
| Aluminum sulfate | 15 g |
| Sulfuric acid | 2 g |
| Glacial acetic acid | 22 g |
| Water to make | 1 liter |
| (pH was adjusted to 4.2) | |

Each sample was developed with the above developer for 7 minutes at 20° C. (black-and-white development).

Results are shown in Table 4.

The graininess (RMS granularity) of each sample is represented by a value of 1,000 times the standard deviation of the density variation that occurred when scanned with a microdensitometer, according to *Photographic Science and Engineering,* Vol. 19, p. 235 (1975).

The sharpness of each sample was represented by MTF value as measured in a similar manner to that in Example 1.

TABLE 4

| Sample No. | Additive | Amount of additive (mole/m$^2$) | Addition of non-light-sensitive emulsion to 3rd layer | MTF (10 line/mm) | | Granularity (D = 1.5) | |
|---|---|---|---|---|---|---|---|
| | | | | Developer (E) | Developer (F) | Developer (E) | Developer (F) |
| 401* | — | — | Not added | 28 | 26 | 0.88 | 0.82 |
| 402* | — | — | Added | 28 | 26 | 0.88 | 0.84 |
| 403* | Compound A | $1\times10^{-5}$ | Not added | 27 | 25 | 0.90 | 0.83 |
| 404* | " | " | Added | 27 | 25 | 0.90 | 0.86 |
| 405* | (3) | " | Not added | 22 | 20 | 0.98 | 0.91 |
| 406* | (31) | " | Not added | 23 | 21 | 0.96 | 0.90 |
| 407 | (3) | " | Added | 22 | 20 | 0.98 | 0.95 |
| 408 | (31) | " | Added | 23 | 21 | 0.96 | 0.92 |

(Note) *Comparative sample

The above results prove the fact that the samples of the present invention have better graininess and sharpness than the comparative samples and that the variation of the photographic characteristics of the samples of the present invention is small, when developed with Developer (E) and Developer (F).

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one light-sensitive silver halide emulsion layer containing an iodine-containing silver halide on a support and having one or more auxiliary layers on the outermost surface of a light-sensitive silver halide emulsion layer positioned farthest from the support, wherein at least one of the auxiliary layers contains a substantially non-light-sensitive silver halide emulsion or a silver halide emulsion containing grains whose inner part or surface part is fogged, and the material contains at least one compound represented by formula (I)

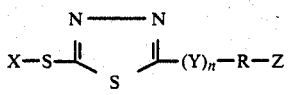

(I)

wherein

R represents a straight or branched alkylene, alkenylene, aralkylene, or arylene group;

Z represents a polar substituent excluding sulfonic acid group, carboxylic acid group, hydroxy group, and an alkoxycarbonyl group;

Y represents

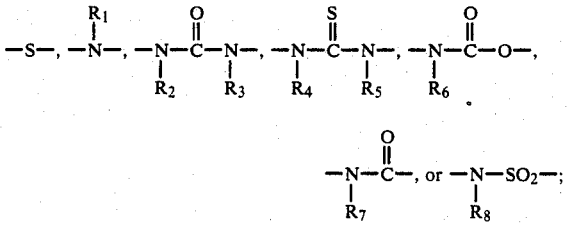

$R_1$, $R_2$, $R_3$, $R_4$, $T_5$, $R_6$, $R_7$, and $R_8$ each represents hydrogen atom or a substituted or unsubstituted alkyl, aryl, alkenyl, or aralkyl group;

X represents hydrogen atom, an alkali metal atom, an ammoniumyl group, or a precursor capable of being replaced with hydrogen atom or an alkali metal under an alkali condition; and n is 0 or 1.

2. A silver halide photographic material as in claim 1, wherein Z in formula (I) represents a substituted or unsubstituted amino group, a quaternary ammoniumyl group, an alkoxy group, an aryloxy group, an alkylthio group, an arylthio group, a heterocyclic-oxy group, a heterocyclic-thio group, a sulfonyl group, a carbamoyl group, a sulfamoyl group, a carbonamido group, a sulfonamido group, an acyloxy group, a ureido group, an acyl group, an aryloxy-carbonyl group, a thioureido group, a sulfonyloxy group, a heterocyclic group, or a cyano group.

3. A silver halide photographic material as in claim 1, wherein Z represents a substituted or unsubstituted amino group or a salt thereof.

4. A silver halide photographic material as in claim 1, wherein R represents an alkylene group, Y represents —S—, and n is 1.

5. A silver halide photographic material as in claim 3, wherein R represents an alkylene group, Y represents —S—, and n is 1.

6. A silver halide photographic material as in claim 1, wherein the amount of the compound of formula (I) incorporated in the material is from $10^{-1}$ to $10^{-5}$ mole per mole of the silver halide in the same layer or in an adjacent layer.

7. A silver halide photographic material as in claim 6, wherein the amount of the compound of formula (I) incorporated in the material is from $3\times10^{-2}$ to $3\times10^{-4}$ mole per mole of the silver halide in the same layer or in an adjacent layer.

8. A silver halide photographic material as in claim 1, wherein the amount of the silver halide emulsion contained in the auxiliary layer is from 0.01 to 1 g/m$^2$.

9. A silver halide photographic material as in claim 8, wherein the amount of the silver halide emulsion contained in the auxiliary layer is from 0.03 to 0.5 g/m$^2$.

10. A silver halide photographic material as in claim 1, wherein the silver halide emulsion in the auxiliary layer comprises any of silver chloride, silver bromide, silver bromochloride, silver bromoiodide, and silver bromoiodochloride, wherein the iodine content thereof is 3 mole% or less.

11. A silver halide photographic material as in claim 10, wherein the iodine content is 1.5 mole% or less.

12. A silver halide photographic material as in claim 1, wherein the silver halide emulsion of the auxiliary layer comprises monodisperse grains.

13. A silver halide photographic material as in claim 1, wherein said at least one light-sensitive silver halide emulsion layer contains an iodine-containing silver halide having an iodine content of from 0.5 to 15 mole% and being selected from the group consisting of silver bromoiodochloride, silver bromoiodide, and silver iodochloride.

14. A silver halide photographic material as in claim 13, wherein the iodine content of the iodine-containing silver halide is from 1.0 to 12 mole%.

15. A silver halide photographic material as in claim 1, wherein the one or more auxiliary layers contain the substantially non-light-sensitive silver halide emulsion.

16. A silver halide photographic material as in claim 1, wherein the one or more auxiliary layers contain the silver halide emulsion containing grains whose inner part or surface part is fogged.

17. A silver halide photographic material as in claim 3, wherein Z represents the unsubstituted amino group.

18. A silver halide photographic material as in claim 3, wherein Z represents the substituted amino group and the substituent is an alkyl group having from 1 to 12 carbon atoms, an alkenyl group having from 2 to 12 carbon atoms, an arylalkyl group having from 6 to 18 carbon atoms, or an aryl group having from 6 to 18 carbon atoms where, in the case of a di-substituted amino group, the substituents may be the same or different.

19. A silver halide photographic material as in claim 3, wherein Z represents the salt, and the salt is selected from the group consisting of a hydrochloride of an amino group and a quaternary ammoniumyl group.

* * * * *